US011186891B2

(12) United States Patent
Yamamoto et al.

(10) Patent No.: US 11,186,891 B2
(45) Date of Patent: Nov. 30, 2021

(54) GRAIN-ORIENTED ELECTRICAL STEEL SHEET AND METHOD FOR PRODUCING SAME

(71) Applicant: NIPPON STEEL CORPORATION, Tokyo (JP)

(72) Inventors: Shinji Yamamoto, Tokyo (JP); Yoshiyuki Ushigami, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 0 days.

(21) Appl. No.: 16/628,930

(22) PCT Filed: Jul. 13, 2018

(86) PCT No.: PCT/JP2018/026620
§ 371 (c)(1),
(2) Date: Jan. 6, 2020

(87) PCT Pub. No.: WO2019/013351
PCT Pub. Date: Jan. 17, 2019

(65) Prior Publication Data

US 2020/0208235 A1 Jul. 2, 2020

(30) Foreign Application Priority Data

Jul. 13, 2017 (JP) ..... JP2017-137411

(51) Int. Cl.
*C21D 9/46* (2006.01)
*C21D 8/12* (2006.01)
(Continued)

(52) U.S. Cl.
CPC ..... *C21D 9/46* (2013.01); *C21D 6/008* (2013.01); *C21D 8/1222* (2013.01);
(Continued)

(58) Field of Classification Search
CPC ..... C22C 38/001; C22C 38/002; C22C 38/02; C22C 38/04; C22C 38/06; C22C 38/60;
(Continued)

(56) References Cited

U.S. PATENT DOCUMENTS 6,214,473 B1 4/2001 Hunt et al.
2009/0233114 A1 9/2009 Takeda et al.
(Continued)

FOREIGN PATENT DOCUMENTS

GB 2153520 A * 8/1985 ..... C21D 3/04
JP 49-96920 A 9/1974
(Continued)

OTHER PUBLICATIONS

International Search Report for PCT/JP2018/026620 dated Sep. 18, 2018.
(Continued)

*Primary Examiner* — Jenny R Wu
(74) *Attorney, Agent, or Firm* — Birch, Stewart, Kolasch & Birch, LLP

(57) ABSTRACT

A grain-oriented electrical steel sheet includes: a base steel sheet; an intermediate layer arranged in contact with the base steel sheet; and an insulation coating arranged in contact with the intermediate layer to be an outermost surface, in which a Cr content of the insulation coating is 0.1 at % or more on average, and when viewing a cross section whose cutting direction is parallel to a thickness direction, the insulation coating has a compound layer containing a crystalline phosphide in an area in contact with the intermediate layer.

5 Claims, 2 Drawing Sheets

(51) Int. Cl.

| | |
|---|---|
| ***C21D 6/00*** | (2006.01) |
| ***C22C 38/60*** | (2006.01) |
| ***C22C 38/06*** | (2006.01) |
| ***C22C 38/04*** | (2006.01) |
| ***C22C 38/02*** | (2006.01) |
| ***C22C 38/00*** | (2006.01) |
| ***C23C 22/03*** | (2006.01) |

(52) U.S. Cl.
CPC ..... *C21D 8/1233* (2013.01); *C21D 8/1255* (2013.01); *C21D 8/1266* (2013.01); *C21D 8/1272* (2013.01); *C21D 8/1283* (2013.01); *C22C 38/001* (2013.01); *C22C 38/002* (2013.01); *C22C 38/02* (2013.01); *C22C 38/04* (2013.01); *C22C 38/06* (2013.01); *C22C 38/60* (2013.01); *C23C 22/03* (2013.01)

(58) Field of Classification Search
CPC . C21D 1/26; C21D 1/76; C21D 6/008; C21D 8/1205; C21D 8/1222; C21D 8/1233; C21D 8/1255; C21D 8/1261; C21D 8/1266; C21D 8/1272; C21D 8/1283; C21D 9/46; C23C 22/00; C23C 22/03; C23C 28/04; C23C 8/02; C23C 8/18; C23C 8/80; H01F 1/147
See application file for complete search history.

(56) References Cited

U.S. PATENT DOCUMENTS

| | | | |
|---|---|---|---|
| 2014/0377573 | A1 | 12/2014 | Okubo et al. |
| 2020/0056256 | A1 | 2/2020 | Takajo et al. |

FOREIGN PATENT DOCUMENTS

| | | | | | |
|---|---|---|---|---|---|
| JP | 3-130376 | A | | 6/1991 | |
| JP | 5-279747 | A | | 10/1993 | |
| JP | 5-279864 | A | | 10/1993 | |
| JP | 6-184762 | A | | 7/1994 | |
| JP | 7-278833 | A | | 10/1995 | |
| JP | 8-191010 | A | | 7/1996 | |
| JP | 08191010 | A | * | 7/1996 | ..... H01F 1/14783 |
| JP | 9-78252 | A | | 3/1997 | |
| JP | 11-209891 | A | | 8/1999 | |
| JP | 2001-220683 | A | | 8/2001 | |
| JP | 2002-322566 | A | | 11/2002 | |
| JP | 2002-348643 | A | | 12/2002 | |
| JP | 2002-363763 | A | | 12/2002 | |
| JP | 2003-171773 | A | | 6/2003 | |
| JP | 2003-193251 | A | | 7/2003 | |
| JP | 2003-193252 | A | | 7/2003 | |
| JP | 2003-313644 | A | | 11/2003 | |
| JP | 2004-315880 | A | | 11/2004 | |
| JP | 2004-342679 | A | | 12/2004 | |
| JP | 2007-217758 | A | | 8/2007 | |
| JP | 4184809 | B2 | | 11/2008 | |
| RU | 2407818 | C2 | | 12/2010 | |
| WO | WO 2013/099455 | A1 | | 7/2013 | |

OTHER PUBLICATIONS

Written Opinion of the International Searching Authority for PCT/JP2018/026620 (PCT/ISA/237) dated Sep. 18, 2018.

International Search Report (PCT/ISA/210) for International Application No. PCT/JP2018/026622, dated Sep. 18, 2018, with an English translation.

Russian Notice of Allowance and Search Report for Russian Application No. 2020102030/05, dated May 14, 2020, with an English translation.

U.S. Office Action for U.S. Appl. No. 16/626,207, dated Mar. 30, 2021.

Written Opinion of the International Searching Authority (PCT/ISA/237) for International Application No. PCT/JP2018/026622, dated Sep. 18, 2018.

* cited by examiner

GRAIN-ORIENTED ELECTRICAL STEEL SHEET AND METHOD FOR PRODUCING SAME

TECHNICAL FIELD OF THE INVENTION

The present invention relates to a grain-oriented electrical steel sheet excellent in water resistance and a method for producing the same. In particular, the present invention relates to a grain-oriented electrical steel sheet which does not include a forsterite film and which is excellent in the water resistance.

Priority is claimed on Japanese Patent Application No. 2017-137411, filed on Jul. 13, 2017, and the content of which is incorporated herein by reference.

RELATED ART

A grain-oriented electrical steel sheet is a soft magnetic material, is mainly used as a core material of a transformer, and is thus required to have magnetic characteristics such as high magnetic flux density and low iron loss. Therefore, in order to secure the required magnetic characteristics, the crystal orientation of a base steel sheet is controlled to, for example, an orientation (Goss orientation) in which a {110} plane is aligned parallel to a steel sheet surface and a <100> axis is aligned in a rolling direction. In order to increase the alignment of the Goss orientation, a secondary recrystallization process using AlN, MnS or the like as an inhibitor is widely used.

A film and/or a coating is formed on the surface of a base steel sheet in order to reduce iron loss. This film and/or coating has a function of reducing iron loss in the core by securing electrical insulation properties between the electrical steel sheets when the electrical steel sheets are stacked for use, in addition to a function of reducing iron loss for a single electrical steel sheet in itself by applying tension to the base steel sheet.

As a grain-oriented electrical steel sheet in which a film and/or a coating is formed on the surface of a base steel sheet, for example, it is known as a grain-oriented electrical steel sheet in which a final annealed film mainly containing forsterite ($Mg_2SiO_4$) is formed on the surface of a base steel sheet and an insulation coating is formed on the surface of the final annealed film. The final annealed film and the insulation coating respectively have a function of increasing the electrical insulation and applying the tension to the base steel sheet.

The final annealed film is formed by reacting an annealing separator mainly containing magnesia (MgO) with the base steel sheet during a heat treatment, for example, at 600 to 1200° C. for 30 hours or longer in final annealing in which the secondary recrystallization occurs in the base steel sheet. The insulation coating is formed, for example, by applying a coating solution containing a phosphoric acid or a phosphate, a colloidal silica, and a chromic anhydride or a chromate to the base steel sheet after final annealing, by baking at 300 to 950° C. for 10 seconds, and by drying.

Since the coatings must not delaminate from the base steel sheet to achieve the required tension and insulation properties, these coatings are required to have high adhesion to the base steel sheet.

The adhesion of the coating can be mainly obtained by the anchor effect derived from the unevenness of an interface between the base steel sheet and the final annealed film. However, since the unevenness of the interface becomes an obstacle of movement of a magnetic wall when the electrical steel sheet is magnetized, the unevenness is also a factor that hinders the reduction of iron loss. Here, in order to secure the adhesion of the insulation coating and to reduce the iron loss in a state in which the final annealed film is not present and the interface is smoothed, the following techniques have been disclosed.

For example, Patent Document 1 discloses a technique in which a final annealed coating is removed by pickling or the like and the surface of a steel sheet is smoothened by chemical polishing or electrolytic polishing. Patent Document 2 discloses a technique of smoothing the surface of a steel sheet by suppressing the formation of a final annealed film itself using an annealing separator containing alumina ($Al_2O_3$) at the time of final annealing. However, in the techniques of Patent Documents 1 and 2, there is a problem that an insulation coating is difficult to adhere to the base steel sheet surface.

Here, in order to improve coating adhesion to a smoothed base steel sheet surface, it has been suggested to form an intermediate layer (base coating) between a base steel sheet and an insulation coating. For example, Patent Document 3 discloses a technique of forming an intermediate layer by applying an aqueous solution of phosphate or alkali metal silicate, and Patent Documents 4 to 6 discloses techniques of using an externally oxidized silicon oxide layer formed by performing a heat treatment in which temperature and atmosphere are appropriately controlled on a steel sheet for several tens of seconds to several minutes as an intermediate layer.

Although these externally oxidized silicon oxide layers exhibit a certain effect in improvement of adhesion of the insulation coating and a reduction in iron loss due to smoothing of the unevenness of the interface between the base steel sheet and the coating thereof, particularly, coating adhesion is not sufficient for practical use. Thus, further technological development is advanced for the externally oxidized silicon oxide layer.

For example, Patent Document 7 discloses a technique of forming an externally oxidized granular oxide in addition to an externally oxidized layer mainly containing silicon oxide. Patent Document 8 discloses a technique of controlling the structure (cavity) of an externally oxidized layer mainly containing silicon oxide.

Patent Documents 9 and 10 disclose techniques of incorporating metal iron or metal oxide (for example, Si-Mn-Cr oxide, Si-Mn-Cr-Al-Ti oxide, or Fe oxide) in an externally oxidized layer mainly containing silicon oxide to reform the externally oxidized layer. In addition, Patent Document 11 discloses a grain-oriented electrical steel sheet having a plurality of intermediate layers including an oxide layer mainly containing silicon oxide formed by an oxidation reaction and a coating layer mainly containing silicon oxide formed by coating and baking.

In this manner, a grain-oriented electrical steel sheet with good magnetic characteristics and secured coating adhesion by the intermediate layer mainly containing silicon oxide, regardless of the unevenness of the interface between the base steel sheet and the coating thereof is being put to practical use.

On the other hand, in some cases, the insulation coating may be considerably altered or deteriorated by a reaction with moisture in the air or moisture in the oil in which the core is immersed or the like while the electrical steel sheet is being used, and the insulation coating is required to secure water resistance. The alteration or deterioration of the insulation coating not only causes a reduction in tension due to a change in the physical properties of the insulation coating itself, but also leads to a significant reduction in tension and a decrease in insulation properties due to the delamination of the insulation coating. Therefore, securing the water resistance of the insulation coating is a very important problem in consideration of the use environment of the electrical steel sheet.

Generally, in order to secure the water resistance of the insulation coating, the insulation coating often contains Cr. However, in the electrical steel sheet using an externally oxidized layer mainly containing silicon oxide, which is expected to be put into practical use in the future, the problem of the water resistance of the insulation coating is not investigated.

Further, since the coating of the electrical steel sheet is a foreign substance as a magnetic material, and is a factor that reduces the spacing factor when used as a core, it is desirable that the thickness of the coating is as thin as possible. However, when the thickness of the coating is reduced, there is a concern that the water resistance of the coating may be significantly deteriorated.

PRIOR ART DOCUMENT

Patent Document

[Patent Document 1] Japanese Unexamined Patent Application, First Publication No. S49-096920

[Patent Document 2] Japanese Patent No. 4184809 [Patent Document 3] Japanese Unexamined Patent Application, First Publication No. H05-279747

[Patent Document 4] Japanese Unexamined Patent Application, First Publication No. H06-184762

[Patent Document 5] Japanese Unexamined Patent Application, First Publication No. H09-078252

[Patent Document 6] Japanese Unexamined Patent Application, First Publication No. H07-278833

[Patent Document 7] Japanese Unexamined Patent Application, First Publication No. 2002-322566

[Patent Document 8] Japanese Unexamined Patent Application, First Publication No. 2002-363763

[Patent Document 9] Japanese Unexamined Patent Application, First Publication No. 2003-313644

[Patent Document 10] Japanese Unexamined Patent Application, First Publication No. 2003-171773

[Patent Document 11] Japanese Unexamined Patent Application, First Publication No. 2004-342679

DISCLOSURE OF THE INVENTION

Problems to be Solved by the Invention

The layering structure of a typical grain-oriented electrical steel sheet, which is currently widely put to practical use, adopts a three-layer structure of "base steel sheet 1—forsterite film 2A—insulation coating 3" as shown in FIG. 1 as a basic structure. The insulation coating 3 is generally a coating having, as a matrix, an amorphous phosphate formed by applying and baking a solution mainly containing a phosphate (for example, aluminum phosphate) and a colloidal silica.

On the other hand, the layering structure of the grain-oriented electrical steel sheet in which the interface structure between the base steel sheet and the coating is macroscopically uniform and smooth by utilizing a thin intermediate layer adopts a three-layer structure of "base steel sheet 1—intermediate layer 2B—insulation coating 3" as a basic structure as shown in FIG. 2.

However, it has been found that in the layering structure (FIG. 2) having an intermediate layer (intermediate layer 2B) mainly containing silicon oxide (for example, silicon dioxide ($SiO_2$)), compared to the layering structure (FIG. 1) having a final annealed film (forsterite film 2A), the water resistance of the insulation coating is easily deteriorated. The water resistance is significantly deteriorated when the thickness of the coating including the intermediate layer is reduced. In the grain-oriented electrical steel sheet utilizing the intermediate layer developed so far, the water resistance deterioration phenomenon of the insulation coating was not considered.

In order to correspond to social demands for energy saving, it is expected that the grain-oriented electrical steel sheet with iron loss reduced by smoothing the unevenness of the interface between the base steel sheet and the coating thereof can be put to practical use. In order to realize the expectation, it is necessary to solve the water resistance problem that may occur when the steel sheet is used in the actual use environment. Particularly, it is important to propose a layering structure that can ensure sufficient water resistance even under conditions in which the thickness of the intermediate layer is minimized within a range in which coating adhesion can be ensured.

Here, the present invention is made to solve a problem of, in a grain-oriented electrical steel sheet in which an intermediate layer mainly containing silicon oxide is formed, an interface between the base steel sheet and a coating thereof is modified to be a smooth surface to reduce iron loss, and further, an insulation coating containing Cr is formed, sufficiently securing the water resistance of the insulation coating and an object thereof is to provide a grain-oriented electrical steel sheet to solve the above problem.

Means for Solving the Problem

The present inventors have conducted intensive investigations on a method for solving the above problem.

First, the present inventors have estimated that based on the fact that the phenomenon that the water resistance of an insulation coating is deteriorated is significant when the thickness of an intermediate layer mainly containing silicon oxide is reduced, this phenomenon is related to the mass transfer between a base steel sheet and the insulation coating.

Increasing the thickness of the intermediate layer mainly containing silicon oxide is a first solution. However, this solution reduces the spacing factor of the core, and thus the present inventors have considered other methods based on the above estimation and focused on modifying the intermediate layer itself. That is, the present inventors have considered that when the formation process of the intermediate layer is devised, even when the thickness of the intermediate layer is thin, the deterioration of the water resistance of the insulation coating can be avoided, and conducted intensive investigations.

The intermediate layer mainly containing silicon oxide is formed by performing a thermal oxidation treatment (annealing in an atmosphere with a controlled dew point) on a base steel sheet surface on which the formation of a final annealed film is suppressed and the final annealed film is substantially not present, a base steel sheet surface in which a final annealed film is substantially removed, or the like. After the intermediate layer is formed, a coating solution is applied to the surface of the intermediate layer and is baked to form an insulation coating.

When the intermediate layer is formed by thermal oxidation, the present invents have attempted to modify the intermediate layer by consciously allowing some substances to be present on the base steel sheet surface. As a result, it has been found that when the intermediate layer is formed on the base steel sheet surface in a state at least one of Al and Mg exists, and the insulation coating is formed on the surface of the intermediate layer, the water resistance of the insulation coating is improved.

Further, the present inventors have thought of creating a state in which either or both of Al and Mg exist on the base steel sheet surface by purposely remaining a part of the oxide layer and/or an annealing separator which has been removed conventionally. By changing the conditions for remaining the oxide layer and/or the annealing separator, changes in the interface structure between the base steel sheet and the coating thereof and the insulation coating have been investigated.

As a result, the following findings were obtained.

(A) At the time of baking of the insulation coating, Fe is diffused and mixed in the insulation coating from the base steel sheet.

(B) In a case where the Fe content of the insulation coating is low, a considerable amount of Cr is dissolved in an amorphous phosphate which is the matrix of the insulation coating, but in a case where the Fe content of the insulation coating is high, crystalline phosphides of Fe and Cr are formed in the insulation coating.

(C) When the crystalline phosphides are formed, the Cr content of the matrix of the insulation coating is decreased and the water resistance of the insulation coating is deteriorated.

(D) At the time of baking of the insulation coating, the phenomenon that Fe is diffused in the insulation coating from the base steel sheet is changed by the amount of either or both of Al and Mg present on base steel sheet surface at the time of formation of the intermediate layer and in a case where the amount is controlled, Fe diffusion is suppressed and a decrease in the Cr content of the matrix of the insulation coating is suppressed, so that the deterioration of the water resistance of the insulation coating can be avoided.

An aspect of the present invention employs the following.

(1) A grain-oriented electrical steel sheet according to an aspect of the present invention includes: a base steel sheet; an intermediate layer arranged in contact with the base steel sheet; and an insulation coating arranged in contact with the intermediate layer to be an outermost surface, in which a Cr content of the insulation coating is 0.1 at % or more on average, when viewing a cross section whose cutting direction is parallel to a thickness direction (specifically, a cross section parallel to a thickness direction and perpendicular to a rolling direction), the insulation coating has a compound layer containing a crystalline phosphide in an area in contact with the intermediate layer, at least one selected from group consisting of $(Fe,Cr)_3P$, $(Fe,Cr)_2P$, $(Fe,Cr)P$, $(Fe,Cr)P_2$, and $(Fe,Cr)_2P_2O_7$ is contained as the crystalline phosphide, and an average thickness of the compound layer is 0.5 μm or less and ⅓ or less of an average thickness of the insulation coating when viewing the cross section.

(2) In the grain-oriented electrical steel sheet according to (1), when viewing the cross section, the insulation coating may have a Cr-depletion layer in an area in contact with the compound layer, a Cr content of the Cr-depletion layer in units of atomic percentage may be less than 80% of the Cr content of the insulation coating, and an average thickness of the Cr-depletion layer may be 0.5 μm or less and ⅓ or less of the average thickness of the insulation coating.

(3) In the grain-oriented electrical steel sheet according to (1) or (2), an average thickness of the intermediate layer may be 2 to 100 nm when viewing the cross section.

(4) A method for producing a grain-oriented electrical steel sheet according to an aspect of the present invention, which is the method for producing the grain-oriented electrical steel sheet according to any one of (1) to (3), includes: a hot-rolling process of heating a slab for a grain-oriented electrical steel sheet to 1280° C. or lower and hot rolling the slab; a hot-band annealing process of hot-band annealing a steel sheet after the hot rolling process; a cold rolling process of cold-rolling a steel sheet after the hot-band annealing process by cold-rolling once or by cold-rolling two times or more times with an intermediate annealing; a decarburization annealing process of decarburization-annealing a steel sheet after the cold rolling process; an annealing separator applying process of applying an annealing separator to a steel sheet after the decarburization annealing process; a final annealing process of final-annealing a steel sheet after the annealing separator applying process; a steel sheet surface modifying process of surface-smoothing a steel sheet after the final annealing process such that at least one of Al or Mg exists in a surface of the steel sheet and the content thereof is 0.03 to 2.00 g/m$^2$; an intermediate layer forming process of forming an intermediate layer on a surface of a steel sheet after the steel sheet surface modifying process by a heat treatment; and an insulation coating forming process of forming an insulation coating on a surface of a steel sheet after the intermediate layer forming process by applying an insulation coating forming solution containing a phosphate, a colloidal silica, and Cr to the steel sheet and baking it.

(5) In the method for producing the grain-oriented electrical steel sheet according to (4), in the steel sheet surface modifying process, a part of a film formed in the final annealing process may be remained and an oxygen content of the remained film may be controlled to 0.05 to 1.50 g/m$^2$.

(6) In the method for producing the grain-oriented electrical steel sheet according to (4) or (5), in the intermediate layer forming process, the intermediate layer may be formed by a heat treatment such that the steel sheet after the steel sheet surface modifying process is heat-treated for 10 to 60 seconds in a temperature range of 600 to 1150° C. in an atmosphere with a dew point of −20 to 0° C., and thereafter, in the insulation coating forming process, the insulation coating may be formed by applying a coating solution containing a phosphoric acid or a phosphate, a colloidal silica, and a chromic anhydride or a chromate to the steel sheet after the intermediate layer forming process and by baking it for 10 seconds or longer in a temperature range of 300 to 900° C.

Effects of the Invention

According to the above aspects of the present invention, it is possible to provide a grain-oriented electrical steel sheet excellent in water resistance since in a grain-oriented electrical steel sheet in which an intermediate layer mainly containing silicon oxide is formed, an interface between a base steel sheet and a coating thereof is modified to be a smooth surface to reduce iron loss, and further, an insulation coating containing Cr is formed, the water resistance of the insulation coating can be sufficiently secured.

EMBODIMENTS OF THE INVENTION

Figure 1:
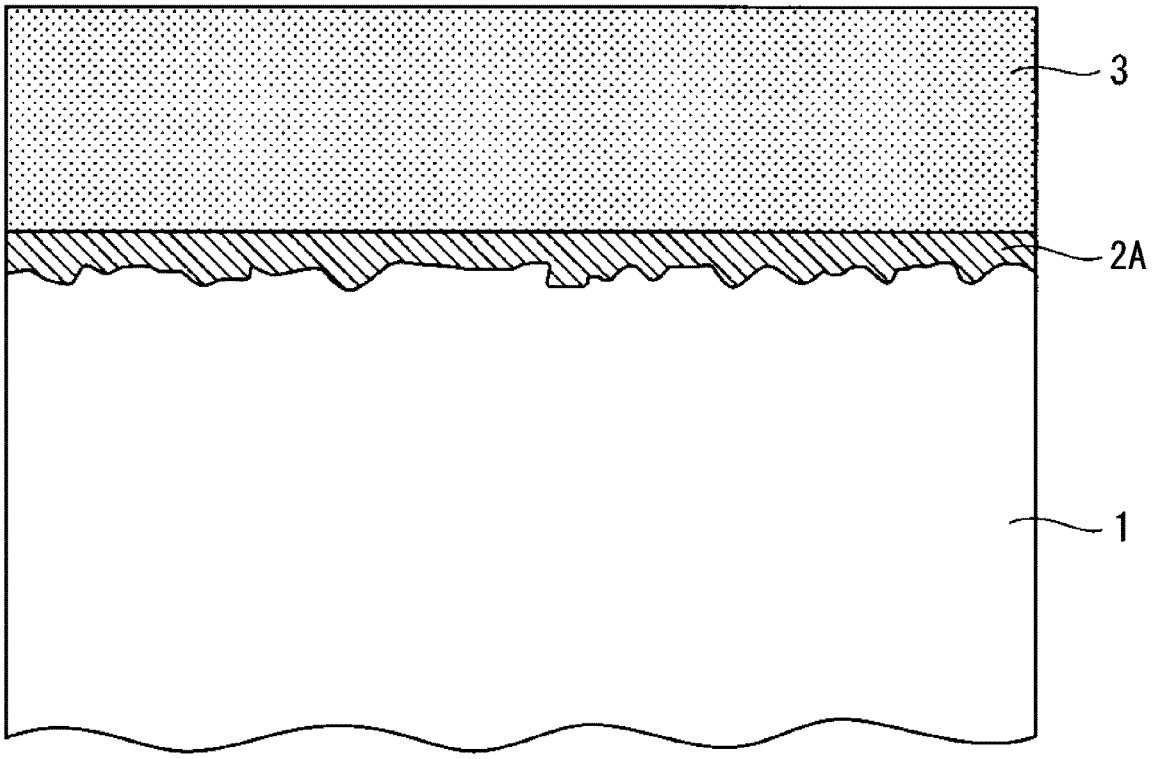
FIG. 1 is a cross-sectional schema showing a layering structure of a grain-oriented electrical steel sheet in the related art.
Figure 2:
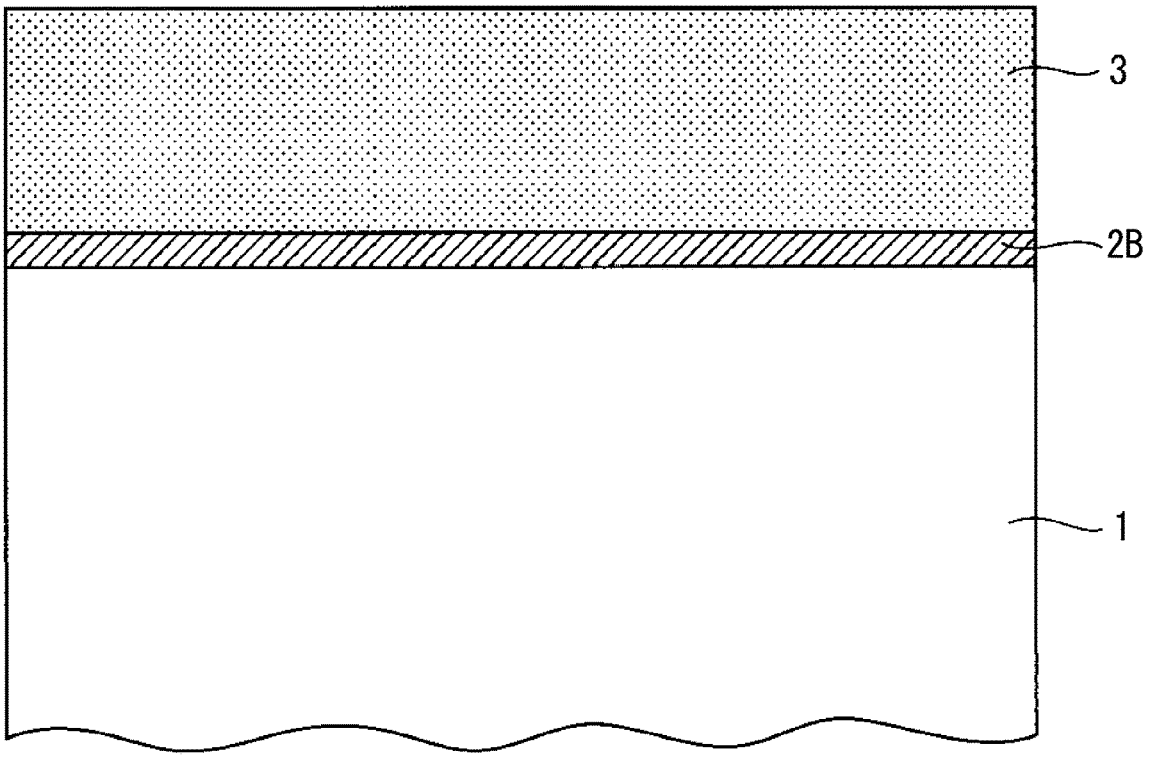
FIG. 2 is a cross-sectional schema showing another layering structure of the grain-oriented electrical steel sheet in the related art.

Hereinafter, a preferable embodiment of the present invention will be described in detail. However, the present invention is not limited only to the configuration which is disclosed in the embodiment, and various modifications are possible without departing from the aspect of the present invention. In addition, the limitation range as described below includes a lower limit and an upper limit thereof. However, the value expressed by "more than" or "less than" is not include in the limitation range.

Hereinafter, a grain-oriented electrical steel sheet according to an embodiment and a method for producing the same will be described in detail.

A. Grain-Oriented Electrical Steel Sheet

A grain-oriented electrical steel sheet according to an embodiment (hereinafter, also referred to as an "electrical steel sheet of the present invention") is a grain-oriented electrical steel sheet in which a final annealed film is substantially not present on the surface of a base steel sheet, an intermediate layer mainly containing silicon oxide is formed on the surface of the base steel sheet, a solution mainly containing a phosphate and a colloidal silica and containing Cr is applied to the surface of the intermediate layer and baked to form an insulation coating, (i) the average of the Cr content of the entire insulation coating may be 0.1 at % or more, and (ii) in the insulation coating, (ii-1) a compound layer in which one or two or more crystalline phosphides of $(Fe,Cr)_3P$, $(Fe,Cr)_2P$, $(Fe,Cr)P$, $(Fe,Cr)P_2$, and $(Fe,Cr)_2P_2O_7$ are present may be formed in an area in contact with the surface of the intermediate layer, and (ii-2) the thickness of the compound layer may be ⅓ or less of the thickness of the insulation coating and may be 0.5 μm or less.

Specifically, the grain-oriented electrical steel sheet according to the embodiment is a grain-oriented electrical steel sheet including a base steel sheet, an intermediate layer arranged in contact with the base steel sheet, and an insulation coating arranged in contact with the intermediate layer to be an outermost surface, the average of the Cr content of the insulation coating may be 0.1 at % or more and 5.1 at % or less, when viewing a cross section whose cutting direction is parallel to a thickness direction (specifically, a cross section parallel to a thickness direction and perpendicular to a rolling direction), the insulation coating may have a compound layer containing a crystalline phosphide in an area in contact with the intermediate layer, at least one selected from group consisting of $(Fe,Cr)_3P$, $(Fe,Cr)_2P$, $(Fe,Cr)P$, $(Fe,Cr)P_2$, and $(Fe,Cr)_2P_2O_7$ may be contained as the crystalline phosphide, and when viewing the cross section, the average thickness of the compound layer may be 50 nm or more and 0.5 μm or less, and ⅓ or less of the average thickness of the insulation coating.

The final annealed film is formed on the surface of the base steel sheet by a reaction between an annealing separator and the base steel sheet during final annealing. The final annealed film may contain not only a reaction product of the annealing separator and the base steel sheet (for example, an inorganic mineral material such as forsterite and oxide containing Al) but also an unreacted annealing separator.

The base steel sheet surface on which the final annealed film is substantially not present means a base steel sheet surface on which the form of the final annealed film is consciously suppressed and the final annealed film is substantially not present, and a base steel sheet surface on which the final annealed film is substantially completely removed from the base steel sheet surface. In addition, the base steel sheet surface on which the final annealed film is substantially not present also includes a base steel sheet surface in which, in a production method described in the section "B. Method for Producing Grain-Oriented Electrical Steel Sheet", a part of the final annealed film is remained on the base steel sheet surface after final annealing in a steel sheet surface modifying process, and then in processes after an intermediate layer forming process, the final annealed film is substantially completely removed.

Hereinafter, the electrical steel sheet of the present invention will be described.

The electrical steel sheet of the present invention is formed in consideration of the alteration of the insulation coating by a reaction between the base steel sheet and the insulation coating such as the diffusion of Fe from the base steel sheet to the insulation coating, which has not been considered in the conventional electrical steel sheet using the intermediate layer mainly containing silicon oxide. By controlling the amount of either or both of Al and Mg present on the base steel sheet surface when the intermediate layer is formed, the intermediate layer is improved, the diffusion of Fe from the base steel sheet to the insulation coating is suppressed, a decrease in the Cr content of the matrix of the insulation coating is suppressed, and as a result, the deterioration of the water resistance of the insulation coating is suppressed.

Figure 3:
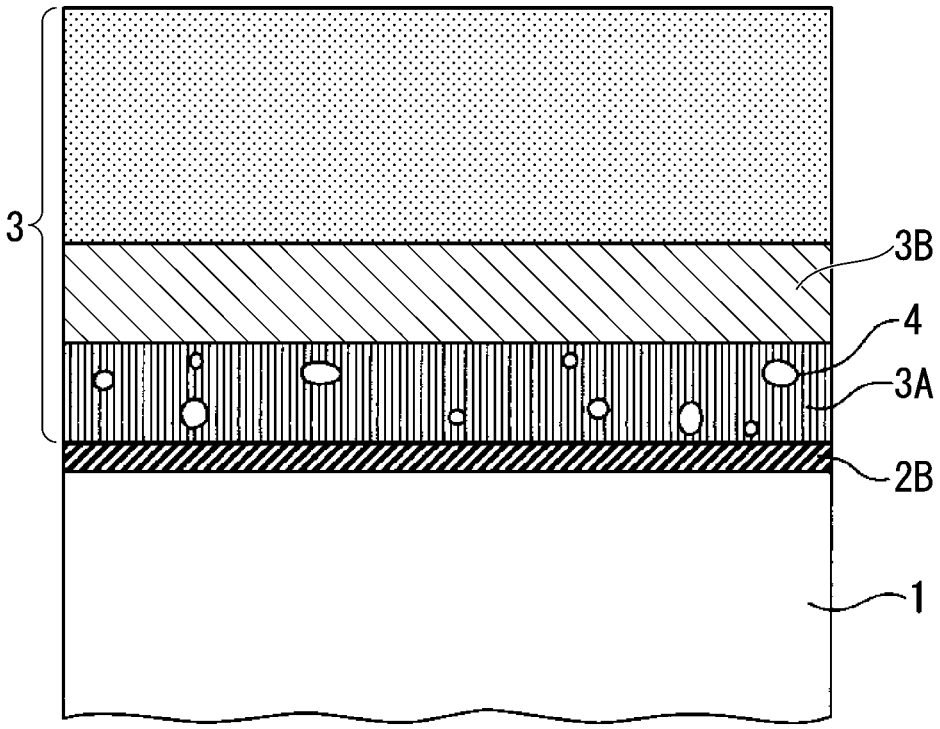
FIG. 3 is a cross-sectional schema showing a layering structure of a grain-oriented electrical steel sheet according to an embodiment of the present invention.

FIG. 3 schematically shows the layering structure of the electrical steel sheet of the present invention. In the layering structure of the electrical steel sheet of the present invention (hereinafter, also referred to as the "layering structure of the present invention"), an intermediate layer 2B is arranged in contact with a base steel sheet 1 and an insulation coating 3 is arranged in contact with the intermediate layer 2B. This insulation coating 3 has a compound layer 3A and a Cr-depletion layer 3B. This compound layer 3A is arranged at a position in contact with the intermediate layer 2B and the Cr-depletion layer 3B is arranged at a position in contact with the compound layer 3A. As described above, the layering structure of the present invention has a five-layer structure described above as a basic structure when viewing a cross section whose cutting direction is parallel to a thickness direction (specifically, a cross section parallel to a thickness direction and perpendicular to a rolling direction).

Hereinafter, each layer of the electrical steel sheet of the present invention will be described.

1. Intermediate Layer

The intermediate layer is a layer which mainly contains silicon oxide and is formed on the base steel sheet surface on which the final annealed film is substantially not present. The intermediate layer has a function of suppressing the diffusion of Fe from the base steel sheet to the insulation coating, in addition to a function of adhesion of the base steel sheet and the insulation coating in the layering structure of the present invention.

The intermediate layer means a layer present between the base steel sheet and the insulation coating (including the Cr-depletion layer and the compound layer). Specifically, the intermediate layer is, for example, a layer formed from a product formed by thermal oxidation (annealing in an atmosphere with a controlled dew point) of the final annealed film and the base steel sheet as described in the section "8. Intermediate Layer Forming Process in B. Method for Producing Grain-Oriented Electrical Steel Sheet", a layer formed from an applied substance, an adhered substance, a plated substance, and/or a product formed by thermal oxidation of the base steel sheet, and the like.

The silicon oxide mainly contained in the intermediate layer is preferably SiOx (x=1.0 to 2.0), and more preferably SiOx (x=1.5 to 2.0) from the viewpoint of stability of silicon oxide. When a sufficient heat treatment is applied to the base steel sheet surface to form silicon oxide, silica ($SiO_2$) can be formed.

In order to form the intermediate layer, the base steel sheet is heat-treated under typical conditions of holding the base steel sheet in an atmosphere including 50 to 80 vol % of hydrogen and a remainder consisting of nitrogen and impurities with a dew point of −20 to 2° C. in a temperature range of 600 to 1150° C. for 10 seconds to 600 seconds. In the intermediate layer formed by this heat treatment, silicon oxide remains amorphous. Therefore, the intermediate layer has high strength to withstand thermal stress, and the elasticity is increased to be a compact material which can easily relieve the thermal stress.

In addition, since the intermediate layer mainly contains silicon oxide, a strong chemical affinity with the base steel sheet containing Si at a high content (for example, Si: 0.80 mass % or more and 4.00 mass % or less) is exhibited and firm adhesion is achieved.

When the thickness of the intermediate layer is thin, the coating adhesion cannot be sufficiently secured, the thermal stress relaxation effect is not sufficiently secured, and a sufficient water resistance cannot be secured by suppressing the alteration of the insulation coating. Thus, the thickness of the intermediate layer is preferably 2 nm or more and more preferably 5 nm or more on average. On the other hand, when the thickness of the intermediate layer is thick, the thickness becomes uneven, and defects such as voids and cracks are generated in the layer. Thus, the thickness of the intermediate layer is preferably 400 nm or less and more preferably 300 nm or less on average.

When the thickness of the intermediate layer is reduced within a range in which the coating adhesion can be secured, the formation time can be shortened, which can also contribute to high productivity, and a decrease in spacing factor when used as a core can be suppressed. Thus, the thickness of the intermediate layer is even more preferably 100 nm or less and most preferably 50 nm or less on average.

The intermediate layer is considered to have a characteristic chemical composition or structure derived from Al and/or Mg present on the base steel sheet surface when the intermediate layer is formed. However, at this point, the characteristics are not apparent in the chemical composition or structure of the intermediate layer.

2. Insulation Coating

The insulation coating is formed by applying a solution mainly containing a phosphate and a colloidal silica and containing Cr to the surface of the intermediate layer and baking the solution. The average of the Cr content in the entire insulation coating is 0.1 at % or more. The upper limit of the Cr content of the entire insulation coating is not particularly limited and is preferably 5.1 at % on average and more preferably 1.1 at % on average. The insulation coating has a function of securing electrical insulation properties between the electrical steel sheets when the electrical steel sheets are stacked for use, in addition to a function of reducing iron loss for a single electrical steel sheet in itself by applying tension to the base steel sheet.

The matrix of the insulation coating is, for example, constituted of an amorphous phosphate and Cr is solid-soluted therein. The amorphous phosphate constituting the matrix is, for example, aluminum phosphate, magnesium phosphate or the like.

In the layering structure of the present invention, as shown in FIG. 3, the insulation coating 3 has the compound layer 3A and the Cr-depletion layer 3B, the compound layer 3A is arranged in contact with the intermediate layer 2B, the Cr-depletion layer 3B is arranged in contact with the compound layer 3A, and the insulation coating (the remainder excluding the compound layer 3A and the Cr-depletion layer 3B) is arranged in contact with the Cr-depletion layer 3B.

(1) Compound Layer

The compound layer contains one or two or more crystalline phosphides of $(Fe,Cr)_3P$, $(Fe,Cr)_2P$, (Fe,Cr)P, $(Fe,Cr)P_2$, and $(Fe,Cr)_2P_2O_7$.

In the electrical steel sheet of the present invention, the atomic ratio of Cr in the metal elements (Fe and Cr) contained in the crystalline phosphide is more than 0%. In a case where the crystalline phosphide does not contain Cr at all, since the Cr content of the matrix of the insulation coating is not decreased, the water resistance of the insulation coating is not deteriorated. Therefore, a problem of "securing water resistance" does not arise. The atomic ratio of the metal elements contained in the crystalline phosphide changes in the thickness direction and the atomic ratio of Fe becomes higher (the atomic ratio of Cr becomes lower) on the side close to the base steel sheet. Generally, in a case of the insulation coating containing Cr, the atomic ratio of Cr in the metal elements contained in the crystalline phosphide is as low as about 90% or less on the side close to the base steel sheet.

The compound layer is formed by forming a crystalline phosphide in the insulation coating. Specifically, Fe diffuses from the base steel sheet to the insulation coating with the intermediate layer therebetween and an area in the insulation coating in contact with the intermediate layer, the Fe content becomes higher. In this area, Fe and Cr react to form a crystalline phosphide, and as a result, the area in which the crystalline phosphide is formed in the insulation coating becomes the compound layer.

When the thickness of the compound layer is more than ⅓ of the thickness of the insulation coating or 0.5 μm, the water resistance of the insulation coating may be deteriorated. In the electrical steel sheet of the present invention, when the intermediate layer is formed, the amount of either or both of Al and Mg present on the base steel sheet surface is controlled as appropriate to suppress the diffusion of Fe from the base steel sheet to the insulation coating. Thus, the thickness of the compound layer is controlled to ⅓ or less of the thickness of the insulation coating and 0.5 μm or less by suppressing the formation of the compound layer, and as a result, the water resistance of the insulation coating can be sufficiently secured.

The average thickness of the compound layer is preferably ⅓ or less of the average thickness of the insulation coating and 0.5 μm or less, more preferably 0.3 μm or less, and even more preferably 0.1 μm or less. The lower limit of the thickness of the compound layer is not particularly limited and may be, for example, 10 nm. The lower limit of the thickness of the compound layer is preferably 50 nm and more preferably 100 nm.

(2) Cr-Depletion Layer

The Cr-depletion layer is an area of which the Cr content is less than 80% with respect to the average value of the Cr content of the entire insulation coating. That is, the average Cr content of the Cr-depletion layer in units of atomic percentage is less than 80% of the average Cr content of the insulation coating. The lower limit of the average Cr content of the Cr-depletion layer is not particularly limited and may be, for example, more than 0%. In addition, it is preferable that the average thickness of the Cr-depletion layer is ⅓ or less of the thickness of the insulation coating and 0.5 μm or less. Thus, the water resistance of the insulation coating can be more sufficiently secured.

The Cr-depletion layer is formed by decreasing the Cr content in the area in contact with the compound layer. Specifically, the formation of the crystalline phosphide decreases the Cr content of the compound layer, Cr diffuses from the insulation coating in contact with the compound layer to the compound layer, and the Cr content in the area in the insulation coating in contact with the compound layer is decreased. As a result, the area in which of which the Cr content is decreased in the insulation coating becomes the Cr-depletion layer.

In a case where the thickness of the Cr-depletion layer is more than ⅓ of the thickness of the insulation coating or 0.5 μm, the water resistance of the insulation coating may be deteriorated. In the electrical steel sheet of the present invention, when the intermediate layer is formed, the amount of either or both of Al and Mg present on the base steel sheet surface is controlled as appropriate to suppress the diffusion of Fe from the base steel sheet to the insulation coating. Thus, the average thickness of the Cr-depletion layer is controlled to ⅓ or less of the thickness of the insulation coating and 0.5 μm or less by suppressing the formation of the Cr-depletion layer, and as a result, the water resistance of the insulation coating can be sufficiently secured.

The average thickness of the Cr-depletion layer is preferably ⅓ or less of the thickness of the insulation coating and 0.5 μm or less, more preferably 0.3 μm or less, and even more preferably 0.1 μm or less. The Cr-depletion layer may not exist at all. That is, the average thickness of the Cr-depletion layer may be 0 μm or more, but the average thickness of the Cr-depletion layer is preferably 50 nm or more. When the average thickness of the Cr-depletion layer is 50 nm or more, the Cr-depletion layer functions as a stress relaxation layer, and thus, the entire insulation coating is a coating capable of easily relaxing thermal stress. The lower limit of the thickness of the Cr-depletion layer is even more preferably 100 nm.

(3) Composition Variation Layer

The area including the compound layer and the Cr-depletion layer is referred to as a composition variation layer.

(4) Entire Insulation Coating. The electrical steel sheet of the present invention is provided to solve the problem that the Cr content in the insulation coating is decreased to deteriorate the water resistance of the insulation coating and the insulation coating is required to contain Cr. In recent years, the development of an insulation coating not containing Cr has also been advanced, but the technical problem of the electrical steel sheet of the present invention does not exist in the electrical steel sheet on which such an insulation coating is formed. The electrical steel sheet of the present invention is characterized in that the average of the Cr content in the entire insulation coating is 0.1 at % or more.

The insulation coating in the electrical steel sheet of the present invention is arranged in contact with the surface of the intermediate layer, the presence state of the crystalline phosphide is controlled according to the thickness direction, and preferably, the Cr content is controlled according to the thickness direction. Therefore, the electrical steel sheet of the present invention is capable of sufficiently securing the water resistance of the insulation coating and can be used for a long period of time in practical use without any problem.

The insulation coating mainly contains a phosphate and a colloidal silica, and contains Cr. This insulation coating is not particularly limited as long as the average of the Cr content in the entire coating is 0.1 at % or more. For example, the coating may contain a chromate. Further, the insulation coating may contain various elements or compounds in order to improve various characteristics, as long as the above effects of the electrical steel sheet of the present invention are not lost.

When the thickness of the insulation coating is thin, the tension applied to the base steel sheet is reduced, the insulation properties are decreased, and, it becomes difficult to secure the water resistance. Therefore, the thickness of the entire insulation coating is preferably 0.1 μm or more and more preferably 0.5 μm or more on average. On the other hand, when the thickness of the entire insulation coating is more than 10 μm, in the formation stage of the insulation coating, there is a concern that cracks may be initiated in the insulation coating. Therefore, the thickness of the entire insulation coating is preferably 10 μm or less and more preferably 5 μm or less on average.

As necessary, magnetic domain refining treatment may be applied to apply local microstrain or form local grooves by laser, plasma, mechanical methods, etching, or other methods.

3. Base Steel Sheet

The electrical steel sheet of the present invention is characterized by having such a five-layer structure. In the electrical steel sheet of the present invention, the chemical composition, structure, or the like of the base steel sheet is not directly related to the layering structure of the present invention. Therefore, in the electrical steel sheet of the present invention, the base steel sheet is not particularly limited, and a typical base steel sheet can be used. Hereinafter, the base steel sheet in the electrical steel sheet of the present invention will be described.

(1) Chemical Composition

The chemical composition of the base steel sheet may be the chemical composition of the base steel sheet in a typical grain-oriented electrical steel sheet. However, since the grain-oriented electrical steel sheet is produced through various processes, preferable compositions of a base steel piece (slab) and the base steel sheet, which are preferable for producing the electrical steel sheet of the present invention will be described below. "%" related to the chemical composition means mass %.

Chemical Composition of Base Steel Sheet

The base steel sheet of the electrical steel sheet of the present invention contains, for example, Si: 0.8 to 7.0%, C: 0.005% or less, N: 0.005% or less, and a remainder consisting of Fe and impurities.

Si: 0.8% or More and 7.0% or Less

Si (silicon) increases the electric resistance of the grain-oriented electrical steel sheet and reduces the iron loss. When the Si content is less than 0.5%, this effect cannot be sufficiently obtained. The lower limit of the Si content is preferably 0.5%, more preferably 0.8%, even more preferably 1.5%, and still more preferably 2.5%. On the other hand, when the Si content is more than 7.0%, the saturation magnetic flux density of the base steel sheet decreases, which makes it difficult to degrade the iron loss. The upper limit of the Si content is preferably 7.0%, more preferably 5.5%, and even more preferably 4.5%. In the electrical steel sheet of the present invention, it is preferable that the Si content of the base steel sheet is 0.8 or more and 7.0% or less.

C: 0.005% or Less

C (carbon) forms a compound in the base steel sheet and degrades the iron loss, so that the amount thereof is preferably small. The C content is preferably limited to 0.005% or less. The upper limit of the C content is preferably 0.004% and more preferably 0.003%.

N: 0.005% or Less

N (nitrogen) forms a compound in the base steel sheet and degrades the iron loss, so that the amount thereof is preferably small. The N content is preferably limited to 0.005% or less. The upper limit of the N content is preferably 0.004% and more preferably 0.003%.

The remainder of the chemical composition of the above base steel sheet consists of Fe and impurities. The "impurities" mentioned herein mean elements that are unavoidably mixed from components contained in the raw materials when the base steel sheet is produced industrially, or components mixed in the production process, and have substantially no effect for the effects of the present invention.

Furthermore, the base steel sheet of the electrical steel sheet of the present invention may contain, instead a portion of Fe as the remainder, as optional elements, for example, at least one selected from acid-soluble Al (acid-soluble aluminum), Mn (manganese), S (sulfur), Se (selenium), (Bi) bismuth, (B) boron, Ti (titanium), Nb (niobium), V (vanadium), Sn (tin), Sb (antimony), Cr (chromium), Cu (copper), P (phosphorus), Ni (nickel), or Mo (molybdenum), within the range that does not inhibit the characteristics.

The amount of the optional elements described above may be, for example, as follows. The lower limit of the optional elements is not particularly limited, and the lower limit value may be 0%. Moreover, even if these optional elements are contained as impurities, the effects of the electrical steel sheet of the present invention are not impaired.

Acid-soluble Al: 0% or more and 0.065 or less,
Mn: 0% or more and 1.00% or less,
S and Se: a total amount of 0% or more and 0.015 or less,
Bi: 0% or more and 0.010% or less,
B: 0% or more and 0.080% or less,
Ti: 0% or more and 0.015% or less,
Nb: 0% or more and 0.20% or less,
V: 0% or more and 0.15% or less,
Sn: 0% or more and 0.10% or less,
Sb: 0% or more and 0.10% or less,
Cr: 0% or more and 0.30% or less,
Cu: 0% or more and 0.40% or less,
P: 0% or more and 0.50% or less,
Ni: 0% or more and 1.00% or less, and
Mo: 0% or more and 0.10% or less.

Composition of Base Steel Piece (Slab)

a. Si: 0.8% or More and 7.0% or Less

Silicon (Si) increases electric resistance and reduces the iron loss. When the Si content is more than 7.0%, cold rolling becomes difficult, and cracking easily occurs at the time of cold rolling. Thus, the Si content is 7.0% or less. The Si content is preferably 4.5% or less and more preferably 4.0% or less. On the other hand, when the Si content is less than 0.8%, austenite γ transformation occurs at the time of final annealing and the crystal orientation of the grain-oriented electrical steel sheet is impaired. Thus, the Si content is 0.8% or more. The Si content is preferably 2.0% or more and more preferably 2.5% or more.

b. C: 0.085% or Less

C (carbon) is an element effective in forming a primary recrystallized structure, but is also an element that adversely affects the magnetic characteristics. Therefore, the steel sheet before final annealing is decarburization-annealed to reduce C. When the C content is more than 0.085%, the decarburization annealing time becomes longer and the productivity in industrial production is impaired. Thus, the C content is 0.085% or less. The C content is preferably 0.080% or less and more preferably 0.075% or less.

The lower limit of the C content is not particularly limited and from the viewpoint of forming a primary recrystallized structure, the C content is preferably 0.020% or more and more preferably 0.050% or more.

c. Acid-soluble Al: 0.010% or More and 0.065% or Less

Acid-soluble Al (acid-soluble aluminum) is an element that bonds to N to form (Al,Si)N that functions as an inhibitor. When the acid-soluble Al content is more than 0.065%, the secondary recrystallization becomes unstable, and thus the acid-soluble Al is 0.065% or less. The acid-soluble Al content is preferably 0.050% or less and more preferably 0.040% or less.

On the other hand, when the acid-soluble Al is less than 0.010%, similarly, the secondary recrystallization becomes unstable, and thus, the acid-soluble Al is 0.010% or more. In the final annealing, from the viewpoint of concentrating Al on the steel sheet surface and utilizing the acid-soluble Al as Al present on the steel sheet surface when the intermediate layer is formed, the acid-soluble Al content is preferably 0.020% or more and more preferably 0.025% or more.

d. N: 0.004% or More and 0.012% or Less N (nitrogen) is an element that bonds to Al to form (Al,Si)N that functions as an inhibitor. When the N content is more than 0.012%, a defect called blister easily occurs in the steel sheet, and thus, the N content is 0.012% or less. The N content is preferably 0.010% or less and more preferably 0.009% or less. On the other hand, when the N content is less than 0.004%, a sufficient amount of inhibitor cannot be obtained, and thus the N content is 0.004% or more. The N content is preferably 0.006% or more and more preferably 0.007% or more.

e. Mn: 0.05% or More and 1.00% or Less

S and/or Se: 0.003% or More and 0.020% or Less

Mn (manganese), S (sulfur), and Se (selenium) are elements for forming MnS and MnSe which function as inhibitors.

When the Mn content is more than 1.00%, the secondary recrystallization becomes unstable, and thus the Mn content is 1.00% or less. The Mn content is preferably 0.50% or less and more preferably 0.20% or less. On the other hand, when the Mn content is less than 0.05%, similarly, the secondary recrystallization becomes unstable, and thus, the Mn content is 0.05% or more. The Mn content is preferably 0.08% or more and more preferably 0.09% or more.

When the S and/or Se content is more than 0.020%, the secondary recrystallization becomes unstable, and thus the S and/or Se content is 0.020% or less. The S and/or Se content is preferably 0.015% or less, more preferably 0.012% or less, and even more preferably 0.010% or less. On the other hand, when S and/or Se content is less than 0.003%, similarly, the secondary recrystallization becomes unstable, and thus the S and/or Se content is 0.003% or more. The S and/or Se content is preferably 0.005% or more and more preferably 0.008% or more.

The expression "the S and/or Se content is 0.003 to 0.015%" means a case where the base steel piece contains one of S and Se, and the amount of one of S and Se is 0.003 to 0.015%, and a case where the base steel piece contains both S and Se and the total amount of S and Se is 0.003 to 0.015%.

f. Remainder

The remainder consists of Fe and impurities. The term "impurities" refers to those incorporated from ore, scrap as a raw material, production environments, or the like when steel is industrially manufactured. That is, in the electrical steel sheet of the present invention, within a range in which the desired characteristics are not inhibited, impurities are allowed to be contained.

Various elements may be contained instead of a portion of Fe in the remainder in consideration of the reinforcement of the inhibitor function by compound formation and the influence on the magnetic characteristics. Examples of the kind and amount of the element to be contained instead of a portion of Fe include Bi (bismuth): 0.010% or less, B (boron): 0.080% or less, Ti (titanium): 0.015% or less, Nb (niobium): 0.20% or less, V (vanadium): 0.15% or less, Sn (tin): 0.10% or less, Sb (antimony): 0.10% or less, Cr (chromium): 0.30% or less, Cu (copper): 0.40% or less, P (phosphorus): 0.50% or less, Ni (nickel): 1.00% or less, and Mo (molybdenum): 0.10% or less. The lower limit of the optional elements is not particularly limited, and the lower limit may be 0%.

(2) Surface Roughness

In the electrical steel sheet of the present invention (the grain-oriented electrical steel sheet having the insulation coating and the intermediate layer), it is preferable that when viewing the cross section parallel to the thickness direction and perpendicular to the rolling direction, unevenness is not formed at the interface between the coating and the base steel sheet. That is, the arithmetic average roughness (Ra) of the roughness of the base steel sheet surface (the interface between the base steel sheet and the coating) is preferably 1.0 μm or less from the viewpoint of reducing the iron loss. The Ra is more preferably 0.8 μm or less and even more preferably 0.6 μm or less. In addition, from the viewpoint of further reducing the iron loss, by applying a large tension to the steel sheet, the Ra of the roughness is more preferably 0.5 μm or less and most preferably 0.3 μm or less.

(3) Thickness of Base Steel Sheet

The thickness of the base steel sheet is not particularly limited and to further reduce the iron loss, the thickness is preferably 0.35 mm or less and more preferably 0.30 mm or less on average. The thickness of the base steel sheet is not particularly limited and the lower limit may be 0.12 mm due to the limitation on production.

B. Method for Producing Grain-Oriented Electrical Steel Sheet

Next, a method for producing a grain-oriented electrical steel sheet according to an embodiment (hereinafter, also referred to as a "production method of the present invention") will be described.

The production method of the present invention is a production method for producing the grain-oriented electrical steel sheet described in the section "A. Grain-Oriented Electrical Steel Sheet" and includes a hot rolling process of heating a slab for a grain-oriented electrical steel sheet to 1280° C. or lower and hot-rolling the slab;

a hot-band annealing process of hot-band annealing a steel sheet after the hot rolling process;

a cold rolling process of cold-rolling a steel sheet after hot-band annealing process by cold-rolling once or by cold-rolling two times or more times with an intermediate annealing;

a decarburization annealing process of decarburization-annealing a steel sheet after the cold rolling process;

an annealing separator applying process of applying an annealing separator to a steel sheet after the decarburization annealing process;

a final annealing process of final-annealing a steel sheet after the annealing separator applying process;

a steel sheet surface modifying process of surface-smoothing a steel sheet after the final annealing process such that at least one of Al or Mg exists in a surface of the steel sheet and the content thereof is 0.03 to 2.00 g/m$^2$;

an intermediate layer forming process of forming an intermediate layer mainly containing silicon oxide on a surface of a steel sheet after the steel sheet surface modifying process by a heat treatment; and an insulation coating forming process of forming an insulation coating on a surface of a steel sheet after the intermediate layer forming process by applying an insulation coating forming solution containing a phosphate, a colloidal silica, and Cr to the surface of the steel sheet and baking the insulation coating forming solution.

The electrical steel sheet of the present invention adopts an intermediate layer to avoid the deterioration of iron loss characteristics caused by unevenness at the interface between the final annealed film and the base steel sheet. By adopting this intermediate layer, the adhesion between the coating and the base steel sheet is secured and also, the water resistance of the insulation coating is improved. Therefore, the production method of the present invention controls the state of the steel sheet to a state in which the amount of either or both of Al and Mg present on the smooth base steel sheet surface is 0.03 to 2.00 g/m$^2$, and this steel sheet is heat-treated to form an intermediate layer. Further, an insulation coating containing Cr is formed on the surface of the intermediate layer. Therefore, the production method of the present invention particularly controls the annealing separator applying process, the final annealing process, the steel sheet surface modifying process, the intermediate layer forming process, and the insulation coating forming process.

Hereinafter, each process of the production method of the present invention will be described. In addition, the production method of the present invention can be variously changed within a range not departing from the spirit of the present invention without being limited to the following production conditions.

1. Hot Rolling Process

A slab for a grain-oriented electrical steel sheet is heated to 1280° C. or lower and subjected to hot rolling. The chemical composition of this slab is not particularly limited to a specific chemical composition. For example, the chemical composition described in the section "A. grain-oriented electrical steel sheet; 3. Base Steel Sheet; (1) Chemical Composition" is preferable.

For example, the slab can be obtained by melting steel of the above-mentioned chemical composition in a converter, an electric furnace, or the like, subjecting the melt to a vacuum degassing treatment if required, then continuously casting and rolling the slab or blooming the slab after ingot-making. The thickness of the slab is not particularly limited and is preferably 150 to 350 mm and more preferably 220 to 280 mm. The slab may be a slab having a thickness of, about 10 to 70 mm (so-called "thin slab"). When a thin slab is used, rough rolling before finish rolling can be omitted in the hot rolling process.

The heating temperature of the slab is 1280° C. or lower. By setting the heating temperature of the slab to 1280° C. or lower, various problems in high temperature heating (for example, a dedicated high temperature heating furnace is required, and the melt scale amount rapidly increases) can be avoided. The lower limit of the heating temperature of the slab is not particularly limited, but when the heating temperature is too low, the hot rolling becomes difficult and the productivity is decreased. Thus, the heating temperature may be set to be in a range of 1280° C. or lower in consideration of productivity. It is also possible to omit slab heating after casting and start hot rolling until the temperature of the slab decreases.

In the hot rolling process, the slab is rough-rolled and further finish-rolled to form a hot-rolled steel sheet having a predetermined thickness. After completing the finish rolling, the hot-rolled steel sheet is wound at a predetermined temperature. The thickness of the heat rolled steel sheet is not particularly limited and is preferably, for example, 3.5 mm or less.

2. Hot-Band Annealing Process

In the hot-band annealing process, the steel sheet after the hot rolling process is hot-band annealed. Although the hot-band annealing conditions may be typical conditions, for example, the steel sheet is held in a temperature range of 750 to 1200° C. for 30 seconds to 10 minutes.

3. Cold Rolling Process

In the cold rolling process, the steel sheet after hot-band annealing process is cold-rolled once or cold-rolled two times or more times with an intermediate annealing. The cold rolling ratio (final cold rolling ratio) in the final cold rolling is not particularly limited and from the viewpoint of controlling the crystal orientation to the desired orientation, the cold rolling ratio is preferably 80% or more and more preferably 90% or more. The thickness of the cold-rolled steel sheet is not particularly limited and in order to further reduce the iron loss, the thickness is preferably 0.35 mm or less and more preferably 0.30 mm or less.

4. Decarburization Annealing Process

In the decarburization annealing process, the steel sheet after the cold rolling process is decarburization-annealed. Specifically, the steel sheet after the cold rolling process is subjected to the decarburization annealing, and thereby, C in the steel sheet is removed and the primary recrystallization is proceeded in the steel sheet. The decarburization annealing is preferably performed in a wet atmosphere to remove C.

5. Annealing Separator Applying Process

In the annealing separator applying process, an annealing separator is applied to the steel sheet after the decarburization annealing process. Examples of the annealing separator include an annealing separator mainly containing alumina ($Al_2O_3$), an annealing separator mainly containing magnesia (MgO), and an annealing separator which has both of these components as main components. The annealing separator is preferably an annealing separator containing Al and/or Mg. In a case where an annealing separator contains Al and/or Mg, Al and/or Mg on the steel sheet surface required when the intermediate layer is formed can be supplied from the final annealed film.

An annealing separator not containing Al and/or Mg may be used. In this case, during the final annealing, the annealing separator and Al in the base steel sheet react with each other to form a final annealed film including an oxide containing a considerable amount of Al on the steel sheet surface. Therefore, Al on the steel sheet surface required when the intermediate layer is formed can be supplied from this final annealed film.

The annealing separator is preferably an annealing separator having alumina as a main component. In this case, it is possible to suppress the formation of unevenness at the interface between the final annealed film and the base steel sheet. The annealing separator having alumina as a main component preferably includes both alumina and magnesia. In this case, since the steel sheet can be purified by incorporating Al in the base steel sheet in the final annealed film, Al in the base steel sheet is internally oxidized so that an increase in iron loss can be suppressed.

In the annealing separator including both alumina and magnesia, the mass ratio of magnesia in the primary components is preferably 20% or more and 60% or less. The mass ratio of magnesia is 20% or more and 50% or less and particularly preferably 20% or more and 40% or less of the annealing separator.

When the mass ratio of magnesia in the main components is less than 20% (the mass ratio of alumina is more than 80%), it is difficult to purify the steel sheet by incorporating Al in the base steel sheet into the final annealed film in some cases, and thus the mass ratio of magnesia in the main components is preferably 20% or more (the mass ratio of alumina is less than 80%). On the other hand, when the mass ratio of magnesia is more than 60% (the mass ratio of alumina is less than 40%), there is a concern that magnesia and the base steel sheet may react with each other at the time of final annealing to deteriorate the interface between the final annealing coating and the base steel sheet to have unevenness, and thus, the mass ratio of magnesia is preferably 60% or less (the mass ratio of alumina is more than 40%).

The steel sheet to which the annealing separator is applied (decarburization annealed steel sheet) is wound into a coil and is subjected to final annealing in a final annealing process.

6. Final Annealing Process

In the final annealing process, the steel sheet after the annealing separator applying process is subjected to final annealing, and thereby, the secondary recrystallization occurs. During the final annealing, the annealing separator and the base steel sheet react with each other to form a final annealed film on the steel sheet surface. The final annealed film includes a reaction product formed by the reaction between the annealing separator and the base steel sheet, but may include an unreacted annealing separator.

For example, in a case where an annealing separator having alumina as a main component is applied, the annealing separator and the base steel sheet react with each other to form a final annealed film mainly containing an oxide containing Al on the steel sheet surface. In a case where an annealing separator not containing Al is applied, the annealing separator and Al in the base steel sheet react with each other to form a final annealed film mainly containing an oxide containing a considerable amount of Al on the steel sheet surface.

In a case where the annealing separator having magnesia as a main component is applied, the annealing separator and the base steel sheet react with each other to form a final annealed film mainly containing forsterite ($Mg_2SiO_4$) on the steel sheet surface. In a case where the annealing separator containing Al and/or Mg is applied, the annealing separator does not fully react with the base steel sheet and a final annealed film including an unreacted annealing separator is formed.

In the final annealing process, final annealing is preferably performed such that unevenness is not formed at the interface between the final annealed film and the base steel sheet, and final annealing is preferably performed such that a final annealed film including the annealing separator containing Al and/or Mg, and/or a reaction product containing Al and/or Mg is formed. In this case, in the steel sheet surface modifying process, by consciously remaining a part of the final annealed film on the surface of the steel sheet after final annealing, the amount of either or both of Al and Mg remained on the steel sheet surface can be controlled to 0.03 to 2.00 g/m$^2$.

The final annealing conditions are not particularly limited and for example, heating may be performed in a temperature range of 1100 to 1300° C. for 20 to 24 hours.

In a case where the annealing separator containing Al and/or Mg is applied, even when the final annealing conditions are typical final annealing conditions, a final annealed film including the annealing separator containing Al and/or Mg, and/or the reaction product containing Al and/or Mg is formed.

In a case where the annealing separator not containing Al is applied, the annealing separator and Al in the base steel sheet are allowed to react to form a final annealed film mainly containing an oxide containing a considerable amount of Al on the steel sheet surface, the final annealing conditions may not have to be special annealing conditions, and may be typical annealing conditions. In a case where the amount of oxide included in the final annealed film is controlled to an appropriate amount, in the final stage of the final annealing, it is preferable to perform switching to $N_2$ gas after purification annealing is performed in an atmosphere of 100 vol % of hydrogen at 500° C. or higher and a furnace-leaving temperature of 400° C. or higher.

By performing such final annealing, the amount of oxide included in the final annealed film is reduced and in the steel sheet surface modifying process, and thus a load for removing the final annealed film can be reduced.

7. Steel Sheet Surface Modifying Process

In the steel sheet surface modifying process, the steel sheet after the final annealing process is subjected to a surface smoothing treatment and the amount of at least one of Al or Mg present on the surface of the steel sheet is controlled to 0.03 to 2.00 g/m$^2$.

In the steel sheet surface modifying process, the steel sheet surface after final annealing is made smooth so that the iron loss is preferably reduced. Specifically, the arithmetic average roughness (Ra) of the steel sheet surface is controlled to, for example, 1.0 μm or less. The Ra is preferably 0.8 μm or less and more preferably 0.6 μm or less. The iron loss is preferably reduced by the control.

In the steel sheet surface modifying process, the steel sheet surface after final annealing is made smooth and the amount of either or both of Al and Mg present on the surface of the steel sheet is controlled to 0.03 to 2.00 g/m$^2$. In this modification, the amount is preferably 0.10 to 1.00 g/m$^2$ and more preferably 0.13 to 0.70 g/m$^2$.

When the amount of either or both of Al and Mg present is less than 0.03 g/m$^2$, the thickness of the compound layer is more than ⅓ of the thickness of the insulation coating or 0.5 μm in some cases, and the thickness of the Cr-depletion layer is more than ⅓ of the thickness of the insulation coating or 0.5 μm in some cases. Therefore, since there is a concern that the water resistance of the insulation coating may not be secured, the amount of either or both of Al and Mg present is 0.03 g/m$^2$ or more.

On the other hand, when the amount of either or both of Al and Mg present is more than 2.00 g/m$^2$, in the intermediate layer forming process on the steel sheet surface after the steel sheet surface modifying process, oxidation progresses locally, and the interface between the intermediate layer and the base steel sheet may be deteriorated to have unevenness, which may cause a deterioration of iron loss. Therefore, the amount of either or both of Al and Mg remained is 2.00 g/m$^2$ or less.

The steel sheet surface modifying process is roughly classified into a case where unevenness is formed at the interface between the final annealed film and the base steel sheet and a case where unevenness is not formed at the interface between the final annealed film and the base steel sheet. Hereinafter, each case will be described.

Here, the "case where unevenness is formed at the interface between the final annealed film and the base steel sheet" means a case where, similar to a conventional grain-oriented electrical steel sheet in which a forsterite film is formed as a final annealed film, at the interface between the final annealed film and the base steel sheet, unevenness in the structure of so-called a "root" is formed up to a deep position inside the base steel sheet, and as a result, the iron loss is not preferably reduced. Specifically, this case means a case where the arithmetic average roughness (Ra) of the base steel sheet surface is more than, for example, 1.0 μm.

The "case where unevenness is not formed at the interface between the final annealed film and the base steel sheet" means a case where unevenness is not formed at the interface between the final annealed film and the base steel sheet as it is written. Specifically, this case means a case where the arithmetic average roughness (Ra) of the base steel sheet interface is, for example, 1.0 μm or less.

(1) Case where Unevenness is Formed at Interface Between Final Annealed Film and Base Steel Sheet In a case where unevenness is formed at the interface between the final annealed film and the base steel sheet, in order to preferably reduce the iron loss, in the steel sheet surface modifying process, the final annealed film is completely removed from the steel sheet surface after final annealing and the steel sheet surface is modified to be a smooth surface.

After the base steel sheet surface is modified to be a smooth surface, the amount of either or both of Al and Mg present on the steel sheet surface is controlled to 0.03 to 2.00 g/m$^2$ by a method of applying a solution containing Al and/or Mg or the like to the base steel sheet surface, a method of performing vapor deposition or thermal spraying of Al and/or Mg as a metal element and/or a compound such as an oxide on the base steel sheet surface, a method of plating Al and/or Mg as a pure metal and/or an alloy on the base steel sheet surface, and the like.

In a case where the amount of Al and/or Mg present on the steel sheet surface is controlled by these methods, the total amount of Al and/or Mg can be calculated from the amount of application, the adhesion amount of vapor deposition or spraying, or the amount of plating.

As a method of completely removing the final annealed film, for example, a method of carefully removing the final annealed film by means of pickling, polishing, or the like, and exposing the base steel sheet is preferable. As a method of making the steel sheet surface smooth, for example, a method of smoothing the base steel sheet surface by chemical polishing or electrolytic polishing is preferable. These are regarded as surface smoothing treatments.

(2) Case where Unevenness is not Formed at Interface Between Final Annealed Film and Base Steel Sheet In a case where unevenness is not formed at the interface between the final annealed film and the base steel sheet, the steel sheet surface modifying process is classified into a (a) case where the final annealed film includes an annealing separator containing Al and/or Mg, and/or a reaction product containing Al and/or Mg, and a (b) case where the final annealed film does not include an annealing separator containing Al and/or Mg, and/or a reaction product containing Al and/or Mg. Hereinafter, each case will be described.

(a) Case where Final Annealed Film Includes Annealing Separator Containing Al and/or Mg, and/or Reaction Product Containing Al and/or Mg In a case where the final annealed film includes an annealing separator containing Al and/or Mg, and/or a reaction product containing Al and/or Mg, in the steel sheet surface modifying process, a part of the final annealed film on the steel sheet surface is consciously remained and the steel sheet surface is modified to be a smooth surface.

When a part of the final annealed film is consciously remained and the oxygen content contained in the remained final annealed film is controlled to 0.05 to 1.50 g/m$^2$, the amount of either of both of Al and Mg present on the steel sheet surface can be controlled to 0.03 to 2.00 g/m$^2$.

By the above control, Al and/or Mg on the steel sheet surface required when the intermediate layer is formed is supplied from the final annealed film, and thus the amount of either or both of Al and Mg present on the steel sheet surface can be controlled to 0.03 to 2.00 g/m$^2$. In this case, the total amount of Al and/or Mg required to be present on the steel sheet surface is controlled by replacing the amount with the oxygen content contained in the remained final annealed film.

It is preferable that the oxygen content contained in the remained final annealed film is controlled to 0.12 to 0.70 g/m$^2$, and the amount of either or both of Al and/or Mg present on the steel sheet surface is controlled to 0.10 to 1.00 g/m$^2$. It is more preferable that the oxygen content contained in the remained final annealed film is controlled to 0.17 to 0.35 g/m$^2$, and the amount of either or both of Al and/or Mg present on the steel sheet surface is controlled to 0.13 to 0.70 g/m$^2$.

When the oxygen content contained in the remained final annealed film is small, the water resistance of the insulation coating may not be secured. When the oxygen content is large, the thickness of the intermediate layer is increased and the spacing factor may be decreased when used as a core. When the oxygen content is excessive, it becomes difficult to uniformly maintain the formation reaction of intermediate layer, local oxidation progresses, the interface between intermediate layer and base steel sheet becomes uneven, and thus, the iron loss may be degraded.

In a case where a part of the final annealed film on the steel sheet surface is consciously remained and either or both of Al and Mg present on the steel sheet surface is controlled to 0.03 to 2.00 g/m$^2$, the oxygen content contained in the remained final annealed film or the total amount of Al and/or Mg present on the steel sheet surface may be obtained as follows. The steel sheet with the remained final annealed film is analyzed to determine the oxygen content present per 1 m$^2$ of the steel sheet, or the total amount of Al and Mg. Further, the steel sheet (base steel sheet) in which the final annealed film is completely removed is analyzed to determine the oxygen content present per 1 m$^2$ of the steel sheet, or the total amount of Al and Mg. The target value may be determined from a difference between these two analysis results.

As a method of allowing a part of the final annealed film, for example, pickling, polishing, or the like may be performed so as to remain a part of the final annealed film. This is regarded as a surface smoothing treatment.

(b) Case where Final Annealed Film does not Include Annealing Separator Containing Al and/or Mg, and/or Reaction Product Containing Al and/or Mg In a case where the final annealed film does not Include an annealing separator containing Al and/or Mg, and/or a reaction product containing Al and/or Mg, since the final annealed film is not required, in the steel sheet surface modifying process, the final annealed film is completely removed from the steel sheet surface, and the steel sheet surface is modified to be a smooth surface.

Then, after the final annealed film is completely removed, the amount of Al and/or Mg present on the steel sheet surface is controlled to 0.03 to 2.00 g/m$^2$. The method of controlling the total amount of Al and/or Mg present on the steel sheet surface is the same as the method described in the section "(1) Case Where Unevenness Is Formed at Interface Between Final Annealed Film and Base Steel Sheet".

In addition, the method of completely removing the final annealed film and the method of making the steel sheet surface smooth are the same as the methods described in the section "(1) Case Where Unevenness Is Formed at Interface Between Final Annealed Film and Base Steel Sheet".

(3) Preferable Steel Sheet Surface Modifying Process

The method of controlling the total amount of Al and/or Mg present on the steel sheet surface in the section "(1) Case Where Unevenness Is Formed at Interface Between Final Annealed Film and Base Steel Sheet" is direct and simple, but is difficult to be incorporated in the method of continuously producing a steel sheet like an electrical steel sheet at high speed. In a case where the method is incorporated in the production method, there is a concern that the production cost may be very high.

For this reason, the present inventors have conducted intensive investigations and have found, as a method that is not difficult to be incorporated in the method for producing an electrical steel sheet, causes almost no increase in production cost, and can be practically used, the method of controlling the total amount of Al and Mg present on the steel sheet surface described in the section "(2) Case Where Unevenness Is Not Formed at Interface Between Final Annealed Film and Base Steel Sheet; (a) Case Where Final Annealed Film Includes Annealing Separator Containing Al and/or Mg, and/or Reaction Product Containing Al and/or Mg".

In this method, without adding a new special process of controlling the total amount of Al and/or Mg present on the steel sheet surface, a part of the final annealed film on the steel sheet surface is consciously remained such that the oxygen content contained in the remained final annealed film is 0.05 to 1.50 g/m$^2$, and the amount of either or both of Al and Mg present on the steel sheet surface is controlled to 0.03 to 2.00 g/m$^2$.

In addition, in this method, since the final annealed film that is required to be completely removed with care in the related art is consciously remained such that the oxygen content is 0.05 to 1.50 g/m$^2$, a load for removing the final annealed film can be reduced.

From the viewpoint of the production cost including the productivity, this method is preferable as a method of controlling the total amount of Al and/or Mg present on the steel sheet surface.

8. Intermediate Layer Forming Process

In the intermediate layer forming process, the steel sheet after the steel sheet surface modifying process is heat-treated to form an intermediate layer mainly containing silicon oxide on the surface of the steel sheet. In the intermediate layer forming process, the steel sheet having the treated steel sheet surface is thermally oxidized (annealed in an atmosphere with a controlled dew point) to form the intermediate layer. In a case where a part of the final annealed film is consciously remained on the steel sheet surface in the steel sheet surface modifying process, the intermediate layer is formed from the reaction product derived from the thermal oxidation of the final annealed film and the base steel sheet.

In the steel sheet surface modifying process, in a case where the final annealed film of the steel sheet surface is completely removed, and then a solution containing Al and/or Mg or the like is applied to the steel sheet surface, a case where Al and/or Mg is vacuum deposited or sprayed as a metal element and/or a compound such as an oxide, or a case where Al and/or Mg is plated as a pure metal and/or an alloy, the intermediate layer is formed from an applied substance, a substance adhered by vapor deposition or spraying, a plated substance, and/or a reaction product derived from thermal oxidation of the base steel sheet.

In the intermediate layer forming process, since the steel sheet after the steel sheet surface modifying process is heat-treated, the heat treatment is performed in a state in which the amount of either or both of Al and Mg present on the surface of the steel sheet is 0.03 to 2.00 g/m$^2$. Since the total amount of Al and/or Mg present on the steel sheet surface is 0.03 g/m$^2$ or more, the water resistance of the insulation coating can be secured. Since the total amount of Al and/or Mg present on the steel sheet surface is 2.00 g/m$^2$ or less, the intermediate layer secures the adhesion between the base steel sheet and the insulation coating and the steel sheet surface modified to be a smooth surface can be avoided from being deteriorated to unevenness.

For the same reason, it is preferable to perform a heat treatment in a state in which the amount of either or both of Al and Mg present on the steel sheet surface is 0.10 to 1.00 g/m$^2$, and it is more preferable to perform a heat treatment in a state in which the amount of either or both of Al and Mg present on the steel sheet surface is 0.13 to 0.70 g/m$^2$.

Although the reason why the water resistance of the insulation coating can be secured by performing the heat treatment is not clear, it is considered that Al and/or Mg is taken into the intermediate layer to modify the intermediate layer.

Even in a case of the intermediate layer having the same thickness, Fe is easily diffused in the intermediate layer in which Al and/or Mg is not incorporated, while in the intermediate layer in which Al and/or Mg is incorporated, Fe is not easily diffused. Therefore, it is considered that the intermediate layer is improved by incorporating Al and/or Mg in the intermediate layer, and the diffusion of Fe from the base steel sheet to the insulation coating is suppressed so that the water resistance of the insulation coating is improved.

The intermediate layer is preferably formed to have the thickness described in the section "A. Grain-Oriented Electrical Steel Sheet; 1. Intermediate Layer". As described above, the intermediate layer is formed from a reaction product derived from the thermal oxidation of the final annealed film and the base steel sheet, an adhered substance, a plated substance, and/or a product formed by thermal oxidation of the base steel sheet, and the like. Therefore, a case where the oxygen content contained in the remained final annealed film is large or a case where the total amount of Al and/or Mg contained in an applied substance, an adhered substance, and/or a plated substance is large, the intermediate layer is easily formed to be thick.

The heat treatment conditions are not particularly limited, and from the viewpoint of forming the intermediate layer to have a thickness of 2 to 400 nm, the steel sheet is preferably held in a temperature range of 300 to 1150° C. for 5 to 120 seconds and more preferably held in a temperature range of 600 to 1150° C. for 10 to 60 seconds.

From the viewpoint of not oxidizing the inside of the steel sheet, the atmosphere during the temperature elevating stage and holding stage in the annealing is preferably a reducing atmosphere. A nitrogen atmosphere in which hydrogen is mixed is more preferable. For example, the nitrogen atmosphere in which hydrogen is mixed is preferably an atmosphere including 50% to 80 vol % of hydrogen and a remainder consisting of nitrogen and impurities with a dew point of −20 to 2° C. In the range, an atmosphere including 10 to 35 vol % of hydrogen and a remainder consisting of nitrogen and impurities with a dew point of −10 to 0° C. is preferable.

In the intermediate layer forming process, it is preferable that the steel sheet is heat-treated in a temperature range of 600 to 1150° C. for 10 to 60 seconds in the atmosphere with a dew point of −20 to 0° C. In a case other than the above atmosphere, the oxidation reaction may be of an internal oxidation type, and thus unevenness at the interface between the intermediate layer and the base steel sheet may become remarkable to degrade the iron loss.

From the viewpoint of reaction rate, the heat treatment temperature is preferably 600° C. or higher, but when the temperature is higher than 1150° C., it may be difficult to keep the formation reaction of the intermediate layer uniform, and the unevenness of the interface between the intermediate layer and the base steel sheet may be remarkable to degrade the iron loss. In addition, the strength of the steel sheet may be reduced, a treatment may be not easily performed in a continuous annealing furnace, and the productivity may be decreased. The holding time depends on the conditions of the atmosphere and holding temperature, but from the viewpoint of formation of the intermediate layer, the holding time is preferably 10 seconds or longer. From the viewpoint of avoiding a decrease in productivity, and a decrease in spacing factor caused by an increase in the thickness of the intermediate layer, the holding time is preferably 60 seconds or shorter.

9. Insulation Coating Forming Process

In the insulation coating forming process, an insulation coating forming solution primarily containing a phosphate and a colloidal silica and containing Cr is applied to the steel sheet after the intermediate layer forming process is subjected to and baked to form an insulation coating on the surface of the steel sheet.

In the insulation coating forming process, a coating solution containing a phosphoric acid or a phosphate, a colloidal silica, and a chromic anhydride or a chromate is applied to the surface of the intermediate layer, and baked to form an insulation coating. As the phosphate, for example, phosphates of Ca, Al, Mg, Sr and the like are preferable. As the chromate, chromates of Na, K, Ca, Sr or the like are preferable. Colloidal silica is not particularly limited, and various particle sizes can be used. Various elements and compounds may be added to the coating solution in order to improve various characteristics of the electrical steel sheet of the present invention.

The insulation coating is preferably formed to have the thickness described in the section "A. Grain-Oriented Electrical Steel Sheet; 2. Insulation Coating; (4) Entire Insulation Coating". The baking conditions for the insulation coating may be typical baking conditions, but it is preferable to hold at a temperature range of 300 to 1150° C. for 5 to 300 seconds in an atmosphere including hydrogen, water vapor, and nitrogen, and having an oxidation degree ($P_{H2O}/P_{H2}$) of 0.001 to 1.0 for example.

In the insulation coating forming process, it is more preferable that the coating solution containing a phosphoric acid or a phosphate, a chromic acid or a chromate, and a colloidal silica is applied to the surface of the intermediate layer and that the baking is conducted by holding in an atmosphere with an oxidation degree ($P_{H2O}/P_{H2}$) of 0.001 to 0.1 in a temperature range of 300 to 900° C. for 10 to 300 seconds. When the oxidation degree is less than 0.001, the phosphate may be decomposed to easily form a crystalline phosphide, and the water resistance of the insulation coating is deteriorated in some cases. When the oxidation degree is more than 0.1, the oxidation of the steel sheet easily proceeds, and an oxide by an internally oxidation may be formed to degrade iron loss characteristics.

The baking conditions are not special baking conditions inherent to the production method of the present invention. However, according to the production method of the present invention, since each process is controlled indivisiblely, it is possible to suppress the diffusion of Fe from the base steel sheet to the insulation coating during heating for baking.

In the insulation coating forming process, it is preferable to cool the steel sheet in an atmosphere in which the oxidation degree is kept low so that the insulation coating and the intermediate layer are not changed after baking. The cooling conditions may be typical cooling conditions, but for example, it is preferable to cool the steel sheet in an atmosphere including 75 vol % of hydrogen and a remainder consisting of nitrogen and impurities with a dew point of 5 to 10° C. and an oxidation degree ($P_{H2O}/P_{H2}$) of less than 0.01.

The cooling conditions are preferably such that the oxidation degree is lower than that at the time of baking in the atmosphere for cooling from the holding temperature at the time of baking to 500° C. For example, it is preferable to cool the steel sheet in an atmosphere including 75 vol % of hydrogen and a remainder consisting of nitrogen and impurities with a dew point of 5 to 10° C. and an oxidation degree ($P_{H2O}/P_{H2}$) of 0.0010 to 0.0015.

10. Preferable Production Method of Present Invention

In the production method of the present invention, in consideration of the production coast including productivity, the method of controlling the total amount of Al and/or Mg present on the steel sheet surface is preferably the method described in the section "7. Steel Sheet Surface Modifying Process; (2) Case Where Unevenness Is Not Formed at Interface Between Final Annealed Film and Base Steel Sheet; (a) Case Where Final Annealed Film Includes Annealing Separator Containing Al and/or Mg, and/or Reaction Product Containing Al and/or Mg".

In order to use this method, each condition (for example, the amount of the annealing separator to be applied) until the final annealing process may be controlled, and the total amount of the annealing separator contained in the final annealed film and/or Al and Mg contained in the reaction product may be suppressed. Thus, a work load for removing the final annealed film can be reduced.

The production method of the present invention may further include a typical process. For example, the production method may further have a nitriding treatment process of increasing an N content in the decarburization annealed steel sheet between the start of decarburization annealing and the expression of secondary recrystallization in the final annealing. In this case, even when a temperature gradient applied to the steel sheet at a boundary between the primary recrystallization area and the secondary recrystallization area is small, the magnetic flux density can be stably improved.

The nitriding treatment may be a typical nitriding treatment. For example, a treatment of performing annealing in an atmosphere containing a gas having a nitriding ability such as ammonia, a treatment of final-annealing a decarburization-annealed steel sheet coated with an annealing separator containing a powder having a nitriding ability such as MnN, and the like are preferable.

Each layer of the electrical steel sheet of the present invention is observed and measured as follows.

A test piece is cut out from the grain-oriented electrical steel sheet in which the insulation coating is formed and the layering structure of the test piece is observed with a transmission electron microscope (TEM).

Specifically, a test piece is cut out by focused ion beam (FIB) processing so that the cross section is parallel to the thickness direction and perpendicular to the rolling direction, and the cross-sectional structure of this cross section is observed with a scanning-TEM (STEM) at a magnification at which each layer enters the observed visual field (bright field image). In a case where each layer is not included in the observed visual field, the cross-sectional structure is observed in a plurality of continuous visual fields.

In order to identify each layer in the cross-sectional structure, line analysis is performed along the thickness direction using TEM-EDS (energy dispersive x-ray spectroscopy) and quantitative analysis of chemical composition of each layer is performed. The elements to be quantitatively analyzed are six elements of Fe, P, Si, O, Mg and Cr. In addition, in order to identify the compound layer, identification of the crystal phase by electron beam diffraction is performed in combination with EDS.

From the results of observation of the bright field image by TEM described above, the quantitative analysis of TEM-EDS, and the electron beam diffraction mentioned above, and each layer is identified and the thickness of each layer is measured. The following specification of each layer and the measurement of thickness are all performed on the same scanning line of the same sample.

An area in which the Fe content is 80 at % or more is determined as the base steel sheet.

An area in which the Fe content is less than 80 at %, the P content is 5 at % or more, the Si content is less than 20 at %, the 0 content is 50 at % or more, and the Mg content is 10 at % or less is determined as the insulation coating (including the Cr-depletion layer and the composition variation layer of the compound layer).

An area in which the Fe content is less than 80 at %, the P content is less than 5 at %, the Si content is 20 at % or more, the 0 content is 50 at % or more, and the Mg content is 10 at % or less is determined as the intermediate layer.

When each layer is determined by the components as described above, an area (blank area) which does not correspond to any composition in analysis may be formed.

However, in the electrical steel sheet of the present invention, each layer is specified to have a three-layer structure of a base steel sheet, an intermediate layer, and an insulation coating (including a composition variation layer). The criterions are as follows. First, in a blank area between the base steel sheet and the intermediate layer, the base steel sheet side is regarded as the base steel sheet and the intermediate layer side is regarded as the intermediate layer with the center of the blank area as a boundary. Next, in the blank area between the insulation coating and the intermediate layer, the insulation coating side is regarded as the insulation coating and the intermediate layer side is regarded as the intermediate layer with the center of the blank area as a boundary. Next, in a blank area between the base steel sheet and the insulation coating, the base steel sheet side is regarded as the base steel sheet and the insulation coating side is regarded as the insulation coating with the center of the blank area as a boundary. Next, a blank area between the intermediate layer and the intermediate layer, the base steel sheet, and the insulation coating are regarded as the intermediate layer. Next, a blank area between the base steel sheets and the insulation coating are regarded as the base steel sheet. Next, a blank area between the insulation coatings is regarded as the insulation coating.

Through this procedure, the steel sheet is separated into the base steel sheet, the insulation coating, and the intermediate layer.

Next, it is confirmed whether or not the compound layer is present in the specified insulation coating. It is also confirmed by TEM whether or not this compound layer is present.

Wide area electron beam diffraction is performed on the insulation coating in the observed visual field with an electron beam diameter smaller than 1/20 of the insulation coating or 100 nm, and it is checked whether or not any crystalline phase is included in the electron beam irradiated area by the electron beam diffraction pattern.

When it is confirmed that the crystalline phase is present by the electron beam diffraction pattern, the crystalline phase as the object is checked in the bright field image, electron beam diffraction is performed on the crystalline phase with a narrowed the electron beam so as to obtain information from the crystalline phase as the object can be obtained, and the crystal structure of the crystalline phase as the object is identified from the electron beam diffraction pattern. This identification may be performed using the Powder Diffraction File (PDF) of the International Centre for Diffraction Data (ICDD).

It is possible to determine whether or not the crystalline phase of the object is $(Fe,Cr)_3P$, $(Fe,Cr)_2P$, (Fe,Cr)P, $(Fe,Cr)P_2$, or $(Fe,Cr)_2P_2O_7$ based on the identification of the crystalline phase described above.

Identification as to whether or not the crystalline phase is $(Fe,Cr)_3P$ may be performed based on PDF: No. 01-089-2712 of $Fe_3P$ or PDF: No. 03-065-1607 of $Cr_3P$. Identification as to whether or not the crystalline phase is $(Fe,Cr)_2P$ may be performed based on PDF: No. 01-078-6749 of $Fe_2P$ or PDF: No. 00-045-1238 of $Cr_2P$. Identification as to whether or not the crystalline phase is (Fe,Cr)P may be performed based on PDF: No. 03-065-2595 of FeP of PDF: No. 03-065-1477 of CrP. Identification as to whether or not the crystalline phase is $(Fe,Cr)P_2$ may be performed based on PDF: No. 01-089-2261 of $FeP_2$ or PDF: No. 01-071-0509 of $CrP_2$. Identification as to whether or not the crystalline phase is $(Fe,Cr)_2P_2O_7$ may be performed based on PDF: No. 01-076-1762 of $Fe_2P_2O_7$ or PDF: No. 00-048-0598 of $Cr_2P_2O_7$. In a case where the crystalline phase is identified based on the PDF described above, the crystal structure is identified with an interplanar spacing of ±5% and an interplanar angle tolerance of ±3°.

From the identification result of the crystal structure, point analysis by TEM-EDS is performed on the crystalline phase which can be determined to have the same crystal structure as the above crystalline phosphide. Thus, when, as the chemical composition of the crystalline phase as the object, the total amount of Fe and Cr is 0.1 at % or more, the amount of each of P and O is 0.1 at % or more, the total amount of Fe, Cr, P, and O is 70 at % or more, and the Si content is 10 at % or less, the material is determined as the above-described crystalline phosphide.

The crystal structure and the point analysis by TEM-EDS are performed on 10 crystalline phases in the wide electron beam diffraction beam irradiated area, and in a case where among these, 5 or more are determined as the above-described crystalline phosphides, this area is determined as the compound layer.

The confirmation of whether or not any crystalline phase is present in the above electron beam irradiated area (wide area electron beam irradiation) is performed sequentially so as not to form a void from the interface between the insulation coating and the intermediate layer to the outermost surface along the thickness direction and is repeated until it is confirmed that the crystalline phosphide is not present in the electron beam irradiated area.

With respect to the compound layer specified above, the total length on the scanning line of the electron beam irradiated area determined to be the compound layer is taken as the thickness of the compound layer.

Next, it is confirmed whether or not the Cr-depletion layer is present in the insulation coating specified above. It is also confirmed by TEM whether or not this Cr-depletion layer is present.

The insulation coating area identified above is analyzed by STEM. At the time of analysis, the evaluation value of the void part in the insulation coating is excluded and then evaluation is performed.

In the insulation coating area, in a case where from the outermost surface to the interface between the insulation coating and the intermediate layer, the Cr content during the quantitative analysis is continuously 5 nm or more and the average Cr content in the entire insulation coating is less than 80%, the area interposed between the initial analysis point and the interface is regarded as the composition variation layer. The Cr-depletion layer is an area excluding the compound layer from the composition variation layer.

When the composition variation layer area is smaller than the compound layer area, it is determined that the Cr-depletion layer is not present in the insulation coating. When the composition variation layer area is larger than the compound layer area, the composition variation layer area is the Cr-depletion layer.

The length of the Cr-depletion layer area identified above on the scanning line is regarded as the thickness of the Cr-depletion layer.

The length of each of the insulation coating, the intermediate layer and the Cr-depletion layer area specified above on the scanning line are regarded as the thickness of each layer. When the thickness of each layer is 5 nm or less, analysis is performed along the thickness direction using TEM having a spherical aberration correction function from the viewpoint of spatial resolution, and each layer is specified. When TEM having a spherical aberration correction function is used, EDS analysis can be performed with a spatial resolution of about 0.2 nm.

The identification and thickness measurement of the insulation coating, the intermediate layer, the compound layer and the Cr-depletion layer are performed at 7 places at 1 μm intervals in the direction perpendicular to the thickness direction, and the thickness of each layer at each place is obtained. Thereafter, the average value is obtained by excluding the maximum value and the minimum value from the measurement values of 7 places of one layer. This operation is performed on the insulation coating, the intermediate layer, the compound layer, and the Cr-depletion layer and the thickness of each layer is obtained.

In addition, the arithmetic average roughness (Ra) of the base steel sheet surface of the electrical steel sheet of the present invention is obtained by observing the cross-sectional structure perpendicular to the rolling direction of the steel sheet. Specifically, in the cross-sectional structure of the electrical steel sheet of the present invention (the grain-oriented electrical steel sheet having the insulation coating and the intermediate layer), the position coordinates of the base steel sheet surface in the thickness direction are measured with an accuracy of 0.01 μm or more to calculate Ra.

The measurement is performed in a range of 2 mm continuous at a pitch of 0.1 μm in a direction parallel to the base steel sheet surface (total 20000 points) and this operation is performed at at least 5 places. Then, the average value of the Ra calculation values at each place is set to the Ra of the base steel sheet surface. Since this observation requires a certain degree of observation magnification, observation by SEM is suitable. Further, image processing may be used to measure the position coordinates.

The iron loss (W17/50) of the grain-oriented electrical steel sheet is measured at an alternating current frequency of 50 Hz and an induced magnetic flux density of 1.7 Tesla.

For the water resistance of the coating, a flat test piece of 80 mm×80 mm is rolled around a round bar with a diameter of 30 mm, then the bent portion is immersed in water as it is, and the water resistance is evaluated based on the fraction of remained coating after 1 minute. For the fraction of remained coating, the immersed test piece is stretched flat, the area of the insulation coating that does not delaminate from the test piece is measured, and a value obtained by dividing the area that does not delaminate by the area of the steel sheet is defined as the fraction of remained coating (area %), and the fraction of remained coating is evaluated. For example, calculation may be performed by placing a transparent film with a 1-mm grid scale on the test piece and measuring the area of the insulation coating that does not delaminate.

EXAMPLES

Hereinafter, the effects of an aspect of the present invention will be described in detail with reference to the following examples. However, the condition in the examples is an example condition employed to confirm the operability and the effects of the present invention, so that the present invention is not limited to the example condition. The present invention can employ various types of conditions as long as the conditions do not depart from the scope of the present invention and can achieve the object of the present invention.

The following examples and comparative examples were evaluated based on the above-described observation and measurement methods.

Example 1

A slab including, as a chemical composition, by mass %, Si: 3.0%, C: 0.050%, acid-soluble Al: 0.03%, N: 0.006%, Mn: 0.5%, S and Se: a total amount of 0.01%, and a remainder consisting of Fe and impurities was heat-treated at 1150° C. for 60 minutes and then subjected to hot rolling to obtain a hot-rolled steel sheet having a thickness of 2.6 mm. The hot-rolled steel sheet was subjected to hot-band annealing in which the hot-rolled steel sheet was held at 1120° C. for 200 seconds, immediately cooled, held at 900° C. for 120 seconds, and then rapid cooled. The hot-band annealed sheet was pickled and then subjected to cold rolling to obtain a cold-rolled steel sheet having a final thickness of 0.27 mm.

The cold-rolled steel sheet was subjected to decarburization annealing at 850° C. for 180 seconds in an atmosphere including 75 vol % of hydrogen and a remainder consisting of nitrogen and impurities. The steel sheet after the decarburization annealing was subjected to nitriding annealing at 750° C. for 30 seconds in a mixed atmosphere of hydrogen-nitrogen-ammonia to control the nitrogen content of the steel sheet to 230 ppm.

An annealing separator containing alumina ($Al_2O_3$) as a main component was applied to the steel sheet after the nitriding annealing. Subsequently, the steel sheet was subjected to final annealing by being heated to 1200° C. at a heating rate of 15° C./hr in a mixed atmosphere of hydrogen-nitrogen and then by being held at 1200° C. for 20 hours in a hydrogen atmosphere. Then, the steel sheet was naturally cooled, whereby a steel sheet in which secondary recrystallization was completed was obtained.

In the steel sheet after final annealing, unevenness was not formed at the interface between the final annealed film and the base steel sheet. Specifically, the Ra of the base steel sheet surface after final annealing was as shown in Table 1.

A part of the final annealed film formed on the steel sheet surface was removed, and a part of the final annealed film was consciously remained on the steel sheet surface to change the oxygen content contained in the remained final annealed film as shown in Table 1.

Next, the steel sheet was heated to 800° C. at a heating rate of 10° C./sec in an atmosphere including 75 vol % of hydrogen and a remainder consisting of nitrogen and impurities with a dew point of −2° C., and then was held for 30 seconds. Subsequently, the dew point of the atmosphere was changed as appropriate, and the steel sheet was naturally cooled, whereby an intermediate layer mainly containing silicon oxide was formed on the steel sheet surface.

A coating solution containing a phosphate, a colloidal silica and a chromate was applied to the surface of the intermediate layer. The steel sheet was heated to 850° C. in an atmosphere including 75 vol % of hydrogen and a remainder consisting of nitrogen and impurities, and was held for 30 seconds to bake the insulation coating. Subsequently, the dew point of the atmosphere was changed as appropriate, and the steel sheet was cooled in furnace to 500° C. and then was naturally cooled, whereby an insulation coating containing Cr was formed on the steel sheet surface.

In addition, the structure of the insulation coating is changed when Fe is diffused from the base steel sheet to the insulation coating and mixed therein by heating for baking of the insulation coating.

The layering structure and the Ra of the base steel sheet surface of the prepared grain-oriented electrical steel sheet were evaluated and the water resistance and the magnetic characteristics were evaluated. The evaluation results are shown in Table 1. The final annealed film remained on the steel sheet surface disappeared completely in the processes after the intermediate layer forming process, and the intermediate layer was formed directly on the base steel sheet surface.

TABLE 1

| No. | BASE STEEL SHEET SURFACE Ra AFTER FINAL AN-NEALING [μm] | OXYGEN CON-TENT OF RE-MAINED FINAL AN-NEALED FILM [g/m$^2$] | THICK-NESS OF INTER-MEDIATE LAYER [nm] | THICK-NESS OF INSU-LATION COATING [μm] | AVERAGE OF Cr CONTENT OF ENTIRE INSULA-TION COATING [at %] | THICK-NESS OF COM-POUND LAYER [μm] | THICK-NESS OF Cr-DEPLE-TION LAYER [μm] | BASE STEEL SHEET SURFACE Ra OF GRAIN-ORIENTED ELEC-TRICAL STEEL SHEET [μm] | FRAC-TION OF RE-MAINED COATING [%] | W17/50 [W/kg] | REMARKS |
|---|---|---|---|---|---|---|---|---|---|---|---|
| 1 | 0.4 | 0.03 | 35 | 2.3 | 0.4 | 0.80 | 0.75 | 0.4 | 8 | 0.97 | COMPARATIVE EXAMPLE |
| 2 | 0.5 | 0.08 | 43 | 2.0 | 0.8 | 0.49 | 0.45 | 0.6 | 40 | 0.96 | INVENTION EXAMPLE |
| 3 | 0.5 | 0.10 | 50 | 2.1 | 0.9 | 0.41 | 0.38 | 0.6 | 55 | 0.98 | INVENTION EXAMPLE |
| 4 | 0.5 | 0.25 | 34 | 1.9 | 1.0 | 0.24 | 0.26 | 0.6 | 76 | 0.97 | INVENTION EXAMPLE |
| 5 | 0.9 | 0.64 | 70 | 2.0 | 0.7 | 0.22 | 0.25 | 1.0 | 78 | 1.10 | INVENTION EXAMPLE |
| 6 | 0.7 | 1.55 | 1234 | 2.2 | 0.8 | 0.19 | 0.14 | 1.1 | 80 | 1.42 | COMPARATIVE EXAMPLE |
| 7 | 0.5 | 1.81 | 1226 | 2.1 | 0.8 | 0.19 | 0.11 | 1.2 | 80 | 1.39 | COMPARATIVE EXAMPLE |

*1) THE UNDERLINED VALUES INDICATES OUT OF THE RANGE OF THE PRESENT INVENTION.

As shown in Table 1, in Nos. 2 to 5 in which the oxygen content contained in the final annealed film remained on the steel sheet surface (hereinafter, also referred to as "the oxygen content of the remained final annealed film") was in a range of 0.05 to 1.50 g/m$^2$, the thickness of the compound layer and the thickness of the Cr-depletion layer were ⅓ or less of the thickness of the insulation coating and 0.5 μm or less, the fraction of remained coating was increased, the water resistance was secured, and the iron loss was reduced.

In No. 1 in which the oxygen content of the remained final annealed film was less than 0.05 g/m$^2$, the thickness of the compound layer and the thickness of the Cr-depletion layer were more than ⅓ of the thickness of the insulation coating and 0.5 μm, the fraction of remained coating was decreased, and the water resistance was deteriorated. In Nos. 6 and 7 in which the oxygen content of the remained final annealed film was more than 1.50 g/m$^2$, the thickness of the intermediate layer was remarkably increased, the Ra of the base steel sheet surface was increased, and the iron loss was increased.

Although not shown in Table 1, the crystalline phosphide included in the compound layer was at least one of $(Fe,Cr)_3P$, $(Fe,Cr)_2P$, $(Fe,Cr)P$, $(Fe,Cr)P_2$, and $(Fe,Cr)_2P_2O_7$. In addition, the average Cr content of the Cr-depletion layer in units of atomic percentage was less than 80% of the average Cr content of the entire insulation coating.

Example 2

A slab including, as a chemical composition, by mass %, Si: 3.5%, C: 0.070%, acid-soluble Al: 0.02%, N: 0.01%, Mn: 1.0%, S and Se: a total amount of 0.02%, and a remainder consisting of Fe and impurities was heat-treated at 1150° C. for 60 minutes and then subjected to hot rolling to obtain a hot-rolled steel sheet having a thickness of 2.6 mm. The hot-rolled steel sheet was subjected to hot-band annealing in which the hot-rolled steel sheet was held at 1120° C. for 200 seconds, immediately cooled, held at 900° C. for 120 seconds, and then rapid cooled. The hot-band annealed sheet was pickled and then subjected to cold rolling to obtain a cold-rolled steel sheet having a final thickness of 0.27 mm.

The cold-rolled steel sheet was subjected to decarburization annealing at 850° C. for 180 seconds in an atmosphere including 75 vol % of hydrogen and a remainder consisting of nitrogen and impurities. The steel sheet after the decarburization annealing was subjected to nitriding annealing at 750° C. for 30 seconds in a mixed atmosphere of hydrogen-nitrogen-ammonia to control the nitrogen content of the steel sheet to 200 ppm.

An annealing separator containing alumina ($Al_2O_3$) and magnesia (MgO) as main components mixed at various mass ratios as shown in Table 2 was applied to the steel sheet after the nitriding annealing. Subsequently, the steel sheet was subjected to final annealing by being heated to 1200° C. at a heating rate of 15° C./hr in a mixed atmosphere of hydrogen-nitrogen and then by being held at 1200° C. for 20 hours in a hydrogen atmosphere. Then, the steel sheet was naturally cooled, whereby a steel sheet in which secondary recrystallization was completed was obtained.

A part of the final annealed film formed on the steel sheet surface was removed, and a part of the final annealed film was consciously remained on the steel sheet surface to change the oxygen content contained in the remained final annealed film as shown in Table 2.

Next, the steel sheet was heated to 900° C. at a heating rate of 10° C./sec in an atmosphere including 75 vol % of hydrogen and a remainder consisting of nitrogen and impurities with a dew point of −2° C., and then was held for 30 seconds. Subsequently, the dew point of the atmosphere was changed as appropriate, and the steel sheet was naturally cooled, whereby an intermediate layer mainly containing silicon oxide was formed on the steel sheet surface.

A coating solution containing a phosphate, a colloidal silica and a chromate was applied to the surface of the intermediate layer. The steel sheet was heated to 830° C. in an atmosphere including 75 vol % of hydrogen and a remainder consisting of nitrogen and impurities, and was held for 30 seconds to bake the insulation coating. Subsequently, the dew point of the atmosphere was changed as appropriate, and the steel sheet was cooled in furnace to 500° C. and then was naturally cooled, whereby an insulation coating containing Cr was formed on the steel sheet surface.

The layering structure and the Ra of the base steel sheet surface of the prepared grain-oriented electrical steel sheet were evaluated and the water resistance and the magnetic characteristics were evaluated. The evaluation results are shown in Table 2. The final annealed film remained on the steel sheet surface disappeared completely in the processes after the intermediate layer forming process, and the intermediate layer was formed directly on the base steel sheet surface.

TABLE 2

| No. | MASS RATIO OF ALUMINA [%] | MASS RATIO OF MAGNESIA [%] | OXYGEN CONTENT OF REMAINED FINAL ANNEALED FILM [g/m$^2$] | THICKNESS OF INTERMEDIATE LAYER [nm] | THICKNESS OF INSULATION COATING [μm] | AVERAGE OF Cr CONTENT OF ENTIRE INSULATION COATING [at %] | THICKNESS OF COMPOUND LAYER [μm] | THICKNESS OF Cr-DEPLETION LAYER [μm] | BASE STEEL SHEET SURFACE Ra OF GRAIN-ORIENTED ELECTRICAL STEEL SHEET [μm] | FRACTION OF REMAINED COATING [%] | W17/50 [W/kg] | REMARKS |
|---|---|---|---|---|---|---|---|---|---|---|---|---|
| 1 | 100 | 0 | 0.02 | 25 | 2.0 | 0.8 | 0.81 | 0.79 | 0.5 | 0 | 1.12 | COMPARATIVE EXAMPLE |
| 2 | 90 | 10 | 0.02 | 26 | 2.0 | 1.5 | 0.40 | 0.88 | 1.0 | 0 | 1.14 | COMPARATIVE EXAMPLE |
| 3 | 70 | 30 | 0.03 | 24 | 2.1 | 0.9 | 0.80 | 0.66 | 0.4 | 5 | 0.98 | COMPARATIVE EXAMPLE |
| 4 | 50 | 50 | 0.03 | 28 | 1.9 | 1.1 | 0.88 | 0.60 | 0.3 | 5 | 0.97 | COMPARATIVE EXAMPLE |
| 5 | 40 | 60 | 0.03 | 29 | 2.0 | 1.2 | 0.91 | 0.94 | 0.8 | 5 | 1.10 | COMPARATIVE EXAMPLE |
| 6 | 20 | 80 | 0.03 | 24 | 2.2 | 0.9 | 0.89 | 0.86 | 1.0 | 10 | 1.09 | COMPARATIVE EXAMPLE |
| 7 | 0 | 100 | 0.03 | 25 | 2.1 | 0.8 | 0.71 | 0.69 | 1.0 | 5 | 1.07 | COMPARATIVE EXAMPLE |
| 8 | 100 | 0 | 0.21 | 33 | 1.9 | 0.9 | 0.30 | 0.24 | 0.9 | 78 | 1.10 | INVENTION EXAMPLE |
| 9 | 90 | 10 | 0.20 | 34 | 2.0 | 1.0 | 0.29 | 0.30 | 0.8 | 76 | 1.12 | INVENTION EXAMPLE |
| 10 | 70 | 30 | 0.21 | 30 | 2.0 | 1.1 | 0.25 | 0.34 | 0.6 | 81 | 0.96 | INVENTION EXAMPLE |
| 11 | 50 | 50 | 0.21 | 32 | 2.2 | 1.1 | 0.24 | 0.25 | 0.5 | 84 | 0.95 | INVENTION EXAMPLE |
| 12 | 40 | 60 | 0.21 | 45 | 2.0 | 0.9 | 0.23 | 0.27 | 0.9 | 74 | 1.08 | INVENTION EXAMPLE |
| 13 | 20 | 80 | 0.21 | 67 | 2.2 | 1.0 | 0.35 | 0.22 | 0.7 | 71 | 1.07 | INVENTION EXAMPLE |
| 14 | 0 | 100 | 0.25 | 70 | 2.2 | 1.1 | 0.37 | 0.29 | 0.9 | 70 | 1.05 | INVENTION EXAMPLE |
| 15 | 100 | 0 | 1.53 | 1220 | 1.9 | 0.9 | 0.17 | 0.15 | 1.1 | 80 | 1.54 | COMPARATIVE EXAMPLE |
| 16 | 90 | 10 | 1.60 | 1320 | 2.0 | 0.5 | 0.20 | 0.17 | 1.2 | 78 | 1.57 | COMPARATIVE EXAMPLE |
| 17 | 70 | 30 | 1.55 | 1340 | 1.9 | 0.8 | 0.23 | 0.19 | 1.3 | 83 | 1.34 | COMPARATIVE EXAMPLE |
| 18 | 50 | 50 | 1.58 | 1520 | 2.0 | 0.9 | 0.21 | 0.18 | 1.4 | 86 | 1.33 | COMPARATIVE EXAMPLE |
| 19 | 40 | 60 | 1.56 | 1150 | 2.0 | 0.6 | 0.19 | 0.16 | 1.1 | 76 | 1.51 | COMPARATIVE EXAMPLE |
| 20 | 20 | 80 | 1.53 | 1280 | 2.2 | 0.8 | 0.21 | 0.18 | 1.2 | 73 | 1.50 | COMPARATIVE EXAMPLE |
| 21 | 0 | 100 | 1.55 | 1378 | 2.3 | 0.9 | 0.22 | 0.18 | 1.3 | 72 | 1.47 | COMPARATIVE EXAMPLE |

*1) THE UNDERLINED VALUES INDICATES OUT OF THE RANGE OF THE PRESENT INVENTION.

As shown in Table 2, in Nos. 8 to 14 in which the oxygen content of the remained final annealed film was 0.05 to 1.50 g/m$^2$, regardless of the mass ratio of magnesia and alumina, the thickness of the compound layer and the thickness of the Cr-depletion layer were ⅓ or less of the thickness of the insulation coating and 0.5 μm or less, the fraction of remained coating was increased, the water resistance was secured, and the iron loss was reduced.

In Nos. 1 and 2 to 7 in which the oxygen content of the remained final annealed film was less than 0.05 g/m$^2$, regardless of the mass ratio of magnesia and alumina, the thickness of the compound layer and the thickness of the Cr-depletion layer were more than ⅓ of the thickness of the insulation coating and 0.5 μm, the fraction of remained coating was decreased, and the water resistance was deteriorated. In Nos. 15 to 21 in which the oxygen content of the remained final annealed film was more than 1.50 g/m$^2$, the thickness of the intermediate layer was remarkably increased, the Ra of the base steel sheet surface was increased, and the iron loss was increased.

As shown in Table 2, in Nos. 1 to 21, regardless of the oxygen content of the remained final annealed film, in a case where the mass ratio of magnesia was 20 to 50%, compared to a case of other mass ratios, the Ra of the base steel sheet surface was decreased and the iron loss tended to be reduced.

Although not shown in Table 2, the crystalline phosphide included in the compound layer was at least one of $(Fe,Cr)_3P$, $(Fe,Cr)_2P$, (Fe,Cr)P, $(Fe,Cr)P_2$, and $(Fe,Cr)_2P_2O_7$. In addition, the average Cr content of the Cr-depletion layer in units of atomic percentage was less than 80% of the average Cr content of the entire insulation coating.

Example 3

A slab including, as a chemical composition, by mass %, Si: 2.7%, C: 0.070%, acid-soluble Al: 0.02%, N: 0.01%, Mn: 1.0%, S and Se: a total amount of 0.02% and a remainder consisting of Fe and impurities was heat-treated at 1150° C. for 60 minutes and then subjected to hot rolling to obtain a hot-rolled steel sheet having a thickness of 2.6 mm. The hot-rolled steel sheet was subjected to hot-band annealing in which the hot-rolled steel sheet was held at 1120° C. for 200 seconds, immediately cooled, held at 900° C. for 120 seconds, and then rapid cooled. The hot-band annealed sheet was pickled and then subjected to cold rolling to obtain a cold-rolled steel sheet having a final thickness of 0.30 mm.

The cold-rolled steel sheet was subjected to decarburization annealing at 850° C. for 180 seconds in an atmosphere including 75 vol % of hydrogen and a remainder consisting of nitrogen and impurities. The steel sheet after the decarburization annealing was subjected to nitriding annealing at 750° C. for 30 seconds in a mixed atmosphere of hydrogen-nitrogen-ammonia to control the nitrogen content of the steel sheet to 250 ppm.

An annealing separator having alumina ($Al_2O_3$) and magnesia (MgO) as main components mixed at a mass ratio of 50%:50% was applied to the steel sheet after the nitriding annealing. Subsequently, the steel sheet was subjected to final annealing by being heated to 1200° C. at a heating rate of 15° C./hr in a mixed atmosphere of hydrogen-nitrogen and then by being held at 1200° C. for 20 hours in a hydrogen atmosphere. Then, the steel sheet was naturally cooled, whereby a steel sheet in which secondary recrystallization was completed was obtained.

As shown in Table 3, a part of the final annealed film formed on the steel sheet surface was removed, and a part of the final annealed film was consciously remained on the steel sheet surface to change the oxygen content contained in the remained final annealed film. In Table 3, although the method of removing the final annealed film of No. 5 is denoted as "no removal", this means that the entire final annealed film is remained on the steel sheet surface without removing the final annealed film.

Next, the steel sheet was heated to 800° C. at a heating rate of 10° C./sec in an atmosphere including 75 vol % of hydrogen and a remainder consisting of nitrogen and impurities with a dew point of −2° C., and then, was held for 60 seconds. Subsequently, the dew point of the atmosphere was changed as appropriate, and the steel sheet was naturally cooled, whereby an intermediate layer mainly containing silicon oxide was formed on the steel sheet surface.

A coating solution containing a phosphate, a colloidal silica and a chromate was applied to the surface of the intermediate layer. The steel sheet was heated to 870° C. in an atmosphere including 75 vol % of hydrogen and a remainder consisting of nitrogen and impurities, and was held for 60 seconds to bake the insulation coating. Subsequently, the dew point of the atmosphere was changed as appropriate, and the steel sheet was cooled in furnace to 500° C. and then the steel sheet was naturally cooled, whereby an insulation coating containing Cr was formed on the steel sheet surface.

The layering structure and the Ra of the base steel sheet surface of the prepared grain-oriented electrical steel sheet were evaluated and the water resistance and the magnetic characteristics were evaluated. The results of the evaluation are shown in Table 3. The final annealed film remained on the steel sheet surface disappeared completely in the processes after the intermediate layer forming process, and the intermediate layer was formed directly on the base steel sheet surface.

TABLE 3

| No. | METHOD OF REMOVING FINAL ANNEALED FILM | OXYGEN CONTENT OF REMAINED FINAL ANNEALED FILM [g/m$^2$] | THICKNESS OF INTERMEDIATE LAYER [nm] | THICKNESS OF INSULATION COATING [μm] | AVERAGE OF Cr CONTENT OF ENTIRE INSULATION COATING [at %] | THICKNESS OF COMPOUND LAYER [μm] | THICKNESS OF Cr-DEPLETION LAYER [μm] | BASE STEEL SHEET SURFACE Ra OF GRAIN-ORIENTED ELECTRICAL STEEL SHEET [μm] | FRACTION OF REMAINED COATING [%] | W17/50 [W/kg] | REMARKS |
|---|---|---|---|---|---|---|---|---|---|---|---|
| 1 | PICKLING | 0.21 | 34 | 2.0 | 1.0 | 0.35 | 0.34 | 0.6 | 76 | 0.97 | INVENTION EXAMPLE |
| 2 | MECHANICAL POLISHING WITH SCRAPER BRUSH | 0.21 | 35 | 2.0 | 1.0 | 0.40 | 0.39 | 0.6 | 78 | 0.96 | INVENTION EXAMPLE |

TABLE 3-continued

| No. | METHOD OF REMOVING FINAL ANNEALED FILM | OXYGEN CONTENT OF REMAINED FINAL ANNEALED FILM [g/m$^2$] | THICKNESS OF INTERMEDIATE LAYER [nm] | THICKNESS OF INSULATION COATING [μm] | AVERAGE OF Cr CONTENT OF ENTIRE INSULATION COATING [at %] | THICKNESS OF COMPOUND LAYER [μm] | THICKNESS OF Cr-DEPLETION LAYER [μm] | BASE STEEL SHEET SURFACE Ra OF GRAIN-ORIENTED ELECTRICAL STEEL SHEET [μm] | FRACTION OF REMAINED COATING [%] | W17/50 [W/kg] | REMARKS |
|---|---|---|---|---|---|---|---|---|---|---|---|
| 3 | MECHANICAL POLISHING WITH EMERY PAPER | 0.20 | 37 | 2.1 | 1.1 | 0.25 | 0.40 | 0.6 | 79 | 0.98 | INVENTION EXAMPLE |
| 4 | ELECTROLYTIC POLISHING | 0.22 | 30 | 1.9 | 1.1 | 0.38 | 0.37 | 0.9 | 76 | 1.00 | INVENTION EXAMPLE |
| 5 | NO REMOVAL | 2.06 | 1180 | 2.0 | 1.0 | 0.29 | 0.35 | 1.1 | 78 | 1.45 | COMPARATIVE EXAMPLE |

*1) THE UNDERLINED VALUES INDICATES OUT OF THE RANGE OF THE PRESENT INVENTION.

As shown in Table 3, in Nos. 1 to 4 in which the oxygen content of the remained final annealed film was in a range of 0.05 to 1.50 g/m$^2$, regardless of the kind of the method of removing the final annealed film, the thickness of the compound layer and the thickness of the Cr-depletion layer were ⅓ or less of the thickness of the insulation coating and 0.5 μm or less, the fraction of remained coating was increased, the water resistance was secured, and the iron loss was reduced. On the other hand, in No. 5 in which the oxygen content of the remained final annealed film was more than 1.50 g/m$^2$, the thickness of the intermediate layer was remarkably increased, the Ra of the base steel sheet surface was increased, and the iron loss was increased.

Although not shown in Table 3, the crystalline phosphide included in the compound layer was at least one of $(Fe,Cr)_3P$, $(Fe,Cr)_2P$, $(Fe,Cr)P$, $(Fe,Cr)P_2$, and $(Fe,Cr)_2P_2O_7$. In addition, the average Cr content of the Cr-depletion layer in units of atomic percentage was less than 80% of the average Cr content of the entire insulation coating.

Example 4

A slab including, as a chemical composition, by mass %, Si: 3.3%, C: 0.070%, acid-soluble Al: 0.03%, N: 0.01%, Mn: 0.8%, S and Se: a total amount of 0.01% and a remainder consisting of Fe and impurities was heat-treated at 1150° C. for 60 minutes and then subjected to hot rolling to obtain a hot-rolled steel sheet having a thickness of 2.6 mm. The hot-rolled steel sheet was subjected to hot-band annealing in which the hot-rolled steel sheet was held at 1120° C. for 200 seconds, immediately cooled, held at 900° C. for 120 seconds, and then rapid cooled. The hot-band annealed sheet was pickled and then subjected to cold rolling to obtain a cold-rolled steel sheet having a final thickness of 0.23 mm.

The cold-rolled steel sheet was subjected to decarburization annealing at 850° C. for 180 seconds in an atmosphere including 75 vol % of hydrogen and a remainder consisting of nitrogen and impurities. The steel sheet after the decarburization annealing was subjected to nitriding annealing at 750° C. for 30 seconds in a mixed atmosphere of hydrogen-nitrogen-ammonia to control the nitrogen content of the steel sheet to 200 ppm.

After an annealing separator having alumina ($Al_2O_3$) and magnesia (MgO) as main components mixed at various mass ratios as shown in Table 4 was applied to the steel sheet after the nitriding annealing. Subsequently, the steel sheet was subjected to final annealing by being heated to 1200° C. at a heating rate of 15° C./hr in a mixed atmosphere of hydrogen-nitrogen and then by being held at 1200° C. for 20 hours in a hydrogen atmosphere. Then, the steel sheet was naturally cooled, whereby a steel sheet in which secondary recrystallization was completed was obtained.

In Table 4, regarding Nos. 1 to 10, a part of the final annealed film formed on the steel sheet surface was removed, and a part of the final annealed film was consciously remained on the steel sheet surface to change the oxygen content contained in the remained final annealed film. As shown in Table 4, the total amount of Al and/or Mg present on the steel sheet surface was changed.

Regarding Nos. 11 to 13, the entire final annealed film was removed and then the base steel sheet surface after final annealing was made smooth by electrolytic polishing. Specifically, smoothing was performed so that the Ra of the base steel sheet surface after smoothing was as shown in Table 4. Thereafter, the base steel sheet surface after smoothing was electro-plated with Al and/or Mg as a pure metal and/or an alloy so that as shown in Table 4, the amount of each of Al and Mg present on the steel sheet surface was changed.

Next, the steel sheet was heated to 800° C. at a heating rate of 20° C./sec in an atmosphere including 75 vol % of hydrogen and a remainder consisting of nitrogen and impurities with a dew point of −2° C., and then was held for 60 seconds. Subsequently, the dew point of the atmosphere was changed as appropriate, and the steel sheet was naturally cooled, whereby an intermediate layer mainly containing silicon oxide was formed on the steel sheet surface.

A coating solution containing a phosphate, a colloidal silica and a chromate was applied to the surface of the intermediate layer. The steel sheet was heated to 870° C. in an atmosphere including 75 vol % of hydrogen and a remainder consisting of nitrogen and impurities, and was held for 45 seconds to bake the insulation coating. Subsequently, the dew point of the atmosphere was changed as appropriate, and the steel sheet was cooled in furnace to 500° C. and then was naturally cooled, whereby an insulation coating containing Cr was formed on the steel sheet surface.

The layering structure and the Ra of the base steel sheet surface of the prepared grain-oriented electrical steel sheet were evaluated and the water resistance and the magnetic characteristics were evaluated. The evaluation results are shown in Table 4. The final annealed film remained on the steel sheet surface disappeared completely in the processes after the intermediate layer forming process, and the intermediate layer was formed directly on the base steel sheet surface.

TABLE 4

| No. | MASS RATIO OF ALUMINA [%] | MASS RATIO OF MAGNESIA [%] | BASE STEEL SHEET SURFACE Ra AFTER SMOOTHING [μm] | TOTAL AMOUNT OF Al AND Mg OF STEEL SHEET SURFACE [g/m$^2$] | AMOUNT OF Al ON STEEL SHEET SURFACE [g/m$^2$] | AMOUNT OF Mg ON STEEL SHEET SURFACE [g/m$^2$] | THICKNESS OF INTERMEDIATE LAYER [nm] | THICKNESS OF INSULATION COATING [μm] |
|---|---|---|---|---|---|---|---|---|
| 1 | 100 | 0 | — | 0.17 | 0.15 | 0.02 | 27 | 3.1 |
| 2 | 90 | 10 | — | 0.15 | 0.09 | 0.06 | 26 | 3.0 |
| 3 | 70 | 30 | — | 0.16 | 0.09 | 0.07 | 23 | 2.9 |
| 4 | 50 | 50 | — | 0.20 | 0.11 | 0.90 | 28 | 2.7 |
| 5 | 40 | 60 | — | 0.18 | 0.09 | 0.09 | 27 | 2.8 |
| 6 | 20 | 80 | — | 0.22 | 0.06 | 0.16 | 24 | 3.0 |
| 7 | 0 | 100 | — | 0.17 | 0.05 | 0.12 | 26 | 3.2 |
| 8 | 100 | 0 | — | 2.21 | 2.20 | 0.01 | 1345 | 2.9 |
| 9 | 0 | 100 | — | 2.23 | 0.68 | 1.55 | 1333 | 2.8 |
| 10 | 50 | 50 | — | 0.02 | 0.01 | 0.01 | 19 | 3.1 |
| 11 | 50 | 50 | 0.5 | 0.20 | 0.20 | 0.00 | 20 | 2.9 |
| 12 | 50 | 50 | 0.6 | 0.21 | 0.01 | 0.20 | 23 | 3.0 |
| 13 | 50 | 50 | 0.7 | 0.20 | 0.10 | 0.10 | 21 | 3.1 |

| No. | AVERAGE OF Cr CONTENT OF ENTIRE INSULATION COATING [at %] | THICKNESS OF COMPOUND LAYER [μm] | THICKNESS OF Cr-DEPLETION LAYER [μm] | BASE STEEL SHEET SURFACE Ra OF GRAIN-ORIENTED ELECTRICAL STEEL SHEET [μm] | FRACTION OF REMAINED COATING [%] | W17/50 [W/kg] | REMARKS |
|---|---|---|---|---|---|---|---|
| 1 | 0.8 | 0.31 | 0.23 | 0.9 | 80 | 1.08 | INVENTION EXAMPLE |
| 2 | 0.7 | 0.29 | 0.31 | 0.8 | 78 | 1.07 | INVENTION EXAMPLE |
| 3 | 0.9 | 0.26 | 0.33 | 0.6 | 79 | 0.94 | INVENTION EXAMPLE |
| 4 | 0.8 | 0.24 | 0.25 | 0.5 | 81 | 9.98 | INVENTION EXAMPLE |
| 5 | 1.0 | 0.24 | 0.28 | 1.0 | 78 | 1.10 | INVENTION EXAMPLE |
| 6 | 1.1 | 0.33 | 0.22 | 1.0 | 82 | 1.10 | INVENTION EXAMPLE |
| 7 | 0.9 | 0.36 | 0.30 | 0.9 | 79 | 1.15 | INVENTION EXAMPLE |
| 8 | 0.8 | 0.20 | 0.10 | 1.2 | 91 | 1.44 | COMPARATIVE EXAMPLE |
| 9 | 0.7 | 0.23 | 0.25 | 1.1 | 85 | 1.39 | COMPARATIVE EXAMPLE |
| 10 | 0.6 | 1.40 | 1.60 | 0.9 | 5 | 1.05 | COMPARATIVE EXAMPLE |
| 11 | 0.5 | 0.26 | 0.33 | 0.7 | 76 | 1.04 | INVENTION EXAMPLE |
| 12 | 0.8 | 0.23 | 0.21 | 0.8 | 78 | 1.02 | INVENTION EXAMPLE |
| 13 | 0.9 | 0.24 | 0.25 | 0.8 | 75 | 1 .05 | INVENTION EXAMPLE |

*1) THE UNDERLINED VALUES INDICATES OUT OF THE RANGE OF THE PRESENT INVENTION.

As shown in Table 4, in Nos. 1 to 7 and 11 to 13 in which the total amount of Al and Mg present on the steel sheet surface (hereinafter, referred to as "the total amount of Al and Mg of the steel sheet surface") was 0.03 to 2.00 g/m$^2$, regardless of the mass ratio of magnesia and alumina, the thickness of the compound layer and the thickness of the Cr-depletion layer were ⅓ or less of the thickness of the insulation coating and 0.5 μm or less, the fraction of remained coating was increased, the water resistance was secured, and the iron loss was reduced.

In Nos. 8 and 9 in which the total amount of Al and Mg of the steel sheet surface was more than 2.00 g/m$^2$, the thickness of the intermediate layer was remarkably increased, the Ra of the base steel sheet surface was increased, and the iron loss was increased. In No. 10 in which the total amount of Al and Mg of the steel sheet surface was less than 0.03 g/m$^2$, the thickness of the compound layer and the thickness of the Cr-depletion layer were more than ⅓ of the thickness of the insulation coating and 0.5 μm, the fraction of remained coating was decreased, and the water resistance was deteriorated.

Although not shown in Table 4, the crystalline phosphide included in the compound layer was at least one of $(Fe,Cr)_3P$, $(Fe,Cr)_2P$, $(Fe,Cr)P$, $(Fe,Cr)P_2$, and $(Fe,Cr)_2P_2O_7$. In addition, the average Cr content of the Cr-depletion layer in units of atomic percentage was less than 80% of the average Cr content of the entire insulation coating.

Example 5

A grain-oriented electrical steel sheet was prepared using the same base steel sheet as in (Example 1) above under the same production conditions as in (Example 1) above except that in the coating solution for forming an insulation coating, the proportion of the chromic anhydride was changed. The evaluation results of these grain-oriented electrical steel sheets are shown in Table 5. In Nos. 3 to 5, the thickness of the compound layer and the thickness of the Cr-depletion layer were ⅓ or less of the thickness of the insulation coating and 0.5 μm or less, the fraction of remained coating was increased, the water resistance was secured, and the iron loss was reduced.

TABLE 5

| No. | BASE STEEL SHEET SURFACE Ra AFTER FINAL ANNEALING [μm] | OXYGEN CONTENT OF REMAINED FINAL ANNEALED FILM [g/m$^2$] | THICKNESS OF INTERMEDIATE LAYER [nm] | THICKNESS OF INSULATION COATING [μm] | AVERAGE OF Cr CONTENT OF ENTIRE INSULATION COATING [μm] | THICKNESS OF COMPOUND LAYER [μm] | THICKNESS OF Cr-DEPLETION LAYER [μm] | BASE STEEL SHEET SURFACE Ra OF GRAIN-ORIENTED ELECTRICAL STEEL SHEET [μm] | FRACTION OF REMAINED COATING [%] | W17/50 [W/kg] | REMARKS |
|---|---|---|---|---|---|---|---|---|---|---|---|
| 1 | 0.4 | 0.04 | 29 | 2.1 | 5.01 | 0.76 | 0.73 | 0.4 | 10 | 0.97 | COMPARATIVE EXAMPLE |
| 2 | 0.5 | 0.08 | 45 | 1.9 | 0.08 | 0.52 | 0.43 | 0.5 | 5 | 0.95 | COMPARATIVE EXAMPLE |
| 3 | 0.5 | 0.10 | 48 | 2.0 | 3.42 | 0.46 | 0.37 | 0.6 | 50 | 0.92 | INVENTION EXAMPLE |
| 4 | 0.5 | 0.25 | 38 | 2.0 | 2.24 | 0.26 | 0.25 | 0.5 | 75 | 0.93 | INVENTION EXAMPLE |
| 5 | 0.9 | 0.64 | 73 | 2.1 | 5.11 | 0.25 | 0.23 | 0.9 | 80 | 1.07 | INVENTION EXAMPLE |
| 6 | 0.7 | 1.55 | 1130 | 2.1 | 4.75 | 0.18 | 0.14 | 1.2 | 75 | 1.43 | COMPARATIVE EXAMPLE |
| 7 | 0.5 | 1.81 | 1311 | 2.2 | 3.78 | 0.21 | 0.16 | 1.3 | 80 | 1.50 | COMPARATIVE EXAMPLE |

*1) THE UNDERLINED VALUES INDICATES OUT OF THE RANGE OF THE PRESENT INVENTION.

Although not shown in Table 5, the crystalline phosphide included in the compound layer was at least one of $(Fe,Cr)_3P$, $(Fe,Cr)_2P$, $(Fe,Cr)P$, $(Fe,Cr)P_2$, and $(Fe,Cr)_2P_2O_7$. In addition, the average Cr content of the Cr-depletion layer in units of atomic percentage was less than 80% of the average Cr content of the entire insulation coating.

INDUSTRIAL APPLICABILITY

According to the aspects of the present invention, it is possible to provide a grain-oriented electrical steel sheet excellent in water resistance since in a grain-oriented electrical steel sheet in which an intermediate layer mainly containing silicon oxide is formed, an interface between a base steel sheet and a coating thereof is modified to be a smooth surface to reduce the iron loss, and further, an insulation coating containing Cr is formed, the water resistance of the insulation coating can be sufficiently secured. Therefore, the industrial applicability is high.

BRIEF DESCRIPTION OF THE REFERENCE SYMBOLS

1: base steel sheet
2A: forsterite film
2B: intermediate layer
3: insulation coating
3A: compound layer
3B: Cr-depletion layer
4: crystalline phosphide

What is claimed is:

1. A grain-oriented electrical steel sheet comprising:
a base steel sheet;
an intermediate layer arranged in contact with the base steel sheet; and an insulation coating arranged in contact with the intermediate layer to be an outermost surface, wherein a Cr content of the insulation coating is 0.1 at % or more on average, the insulation coating has a compound layer containing a crystalline phosphide in an area in contact with the intermediate layer when viewing a cross section whose cutting direction is parallel to a thickness direction, at least one selected from group consisting of $(Fe,Cr)_3P$, $(Fe,Cr)_2P$, $(Fe,Cr)P$, $(Fe,Cr)P_2$, and $(Fe,Cr)_2P_2O_7$ is contained as the crystalline phosphide, an average thickness of the compound layer is 0.5 μm or less and ⅓ or less of an average thickness of the insulation coating when viewing the cross section, when viewing the cross section, the insulation coating has a Cr-depletion layer in an area in contact with the compound layer, an average Cr content of the Cr-depletion layer in units of atomic percentage is less than 80% of the Cr content of the insulation coating an average thickness of the Cr-depletion layer is 0.5 μm or less and ⅓ or less of the average thickness of the insulation coating, and an average thickness of the intermediate layer is 2 to 100 nm when viewing the cross section.

2. A method for producing the grain-oriented electrical steel sheet according to claim 1, the method comprising:

a hot rolling process of heating a slab for a grain-oriented electrical steel sheet to 1280° C. or lower and hot-rolling the slab;

a hot-band annealing process of hot-band annealing a steel sheet after the hot rolling process;

a cold rolling process of cold-rolling a steel sheet after the hot-band annealing process by cold-rolling once or by cold-rolling two times or more times with an intermediate annealing;

a decarburization annealing process of decarburization-annealing a steel sheet after the cold rolling process;

an annealing separator applying process of applying an annealing separator to a steel sheet after the decarburization annealing process;

a final annealing process of final-annealing a steel sheet after the annealing separator applying process;

a steel sheet surface modifying process of surface-smoothing a steel sheet after the final annealing process such that at least one of Al or Mg exists in a surface of the steel sheet and the total content of Al and Mg thereof is 0.03 to 2.00 g/rn$^2$;

an intermediate layer forming process of forming an intermediate layer on a surface of a steel sheet after the steel sheet surface modifying process by a heat treatment; and an insulation coating forming process of forming an insulation coating on a surface of a steel sheet after the intermediate layer forming process by applying an insulation coating forming solution containing a phosphate, a colloidal silica, and Cr to the steel sheet and baking it.

3. The method for producing the grain-oriented electrical steel sheet according to claim 2, wherein, in the steel sheet surface modifying process, a part of a film formed in the final annealing process is remained and an oxygen content of the remained film is controlled to 0.05 to 1.50 g/m$^2$.

4. The method for producing the grain-oriented electrical steel sheet according to claim 3, wherein, in the intermediate layer forming process, the intermediate layer is formed by a heat treatment such that the steel sheet after the steel sheet surface modifying process is heat-treated for 10 to 60 seconds in a temperature range of 600 to 1150° C. in an atmosphere with a dew point of −20 to 0° C., and thereafter, in the insulation coating forming process, the insulation coating is formed by applying a coating solution containing a phosphoric acid or a phosphate, a colloidal silica, and a chromic anhydride or a chromate to the steel sheet after the intermediate layer forming process and by baking it for 10 seconds or longer in a temperature range of 300 to 900° C.

5. The method for producing the grain-oriented electrical steel sheet according to claim 2, wherein, in the intermediate layer forming process, the intermediate layer is formed by a heat treatment such that the steel sheet after the steel sheet surface modifying process is heat-treated for 10 to 60 seconds in a temperature range of 600 to 1150° C. in an atmosphere with a dew point of −20 to 0° C., and thereafter, in the insulation coating forming process, the insulation coating is formed by applying a coating solution containing a phosphoric acid or a phosphate, a colloidal silica, and a chromic anhydride or a chromate to the steel sheet after the intermediate layer forming process and by baking it for 10 seconds or longer in a temperature range of 300 to 900° C.

* * * * *